US008398219B2

(12) United States Patent
Chung et al.

(10) Patent No.: US 8,398,219 B2
(45) Date of Patent: Mar. 19, 2013

(54) INK JET PRINTER MODULE AND PRINTER USING THE SAME

(75) Inventors: Kwang Choon Chung, Yongin (KR); Hae Sung Jung, Ansan (KR); Ki Yong Kim, Gwangju (KR); Kyung Soo Kim, Siheung (KR); Sung Chul Jeon, Seoul (KR); Chung Il Kim, Suwon (KR)

(73) Assignee: Inktec Co., Ltd., Ansan (KR)

( * ) Notice: Subject to any disclaimer, the term of this patent is extended or adjusted under 35 U.S.C. 154(b) by 156 days.

(21) Appl. No.: 13/123,674

(22) PCT Filed: Oct. 12, 2009

(86) PCT No.: PCT/KR2009/005844

§ 371 (c)(1),
(2), (4) Date: Apr. 11, 2011

(87) PCT Pub. No.: WO2010/041916

PCT Pub. Date: Apr. 15, 2010

(65) Prior Publication Data

US 2011/0193919 A1 Aug. 11, 2011

(30) Foreign Application Priority Data

Oct. 12, 2008 (KR) ..... 10-2008-0099913

(51) Int. Cl.
*B41J 2/175* (2006.01)

(52) U.S. Cl. ..... 347/85; 347/92; 347/36; 347/74

(58) Field of Classification Search ..... 347/36, 347/74–92

See application file for complete search history.

(56) References Cited

U.S. PATENT DOCUMENTS

| | | | | |
|---|---|---|---|---|
| 5,473,353 | A | 12/1995 | Soucemarianadin et al. | |
| 6,239,822 | B1 | 5/2001 | Zapata et al. | |
| 6,312,094 | B1 | 11/2001 | Ito et al. | |
| 8,181,595 | B2 * | 5/2012 | Kojima | 118/302 |
| 2006/0232644 | A1 | 10/2006 | Graveson et al. | |
| 2009/0315941 | A1 * | 12/2009 | Kojima | 347/22 |

* cited by examiner

*Primary Examiner* — Ellen Kim
(74) *Attorney, Agent, or Firm* — Birch, Stewart, Kolasch & Birch, LLP

(57) ABSTRACT

An ink jet printer module has a module body, an ink inlet port, a washing liquid inlet port and a pneumatic inlet port connected with the main ink tank, the washing liquid tank and the pneumatic pump. A common flow path in the interior of the module body selectively communicates with either the washing liquid flow path or the washing liquid flow path. An ink opening and closing valve is provided at the module body. A pneumatic and washing liquid selection valve is provided in the module body An ink discharge port is provided in the module body discharges the ink of the ink flow path to the outside of the module body. A common discharge port is provided in the module body and discharges either the pneumatic or the washing liquid of the common flow path.

16 Claims, 25 Drawing Sheets

INK JET PRINTER MODULE AND PRINTER USING THE SAME

TECHNICAL FIELD

The present invention relates to a part used for manufacturing an ink jet printer and a printer using the same, and in particular to a module used in an industrial ink jet printer and a printer using the same.

BACKGROUND ART

An ink jet printer is widely used at home and office as well as in the industry because of its excellent printing quality.

Compared to a home or office type printer which is basically designed to print paper sheets, the industrial ink jet printer is basically designed to print paper sheets as well as various printing objects such as woven materials, synthetic resin materials, glass materials, etc. and has a function of printing a large size printing object.

As the ink technology advances a lot, the applicable range of the ink jet printer is diversified. In case of a UV printer, an adhesive force with respect to a printing object as well as a discoloring resistance and durability are excellent, so the UV ink can be widely applied to various materials. A lot of researches are currently under way with respect to the UV ink development and printers using the same. In case of a special ink such as a conductive ink, it can be well applied to electronic parts such as a Printed Circuit Board (PCB) or a RFID antenna with the aid of its very precise patterns along with the advancing ink jet technology.

Since the industrial ink jet printer is manufactured in a large size, it has many structural and functional differences as compared to common small sixed printers.

The above different constructions related with the present invention will be described in brief. The common industrial ink jet printer has a large capacity main ink tank as well as a reservoir ink tank at an upper side of a printer head. The ink pumped from the main ink tank is first inputted into the reservoir ink tank before it is transferred to the printer head. Since the reservoir ink tank is filled with a certain amount of ink, and a water level sensor is installed, the consumption of the ink due to printing is detected by the sensor, and the detected information is transmitted to a printer controller, so the ink is continuously supplied, so a certain level of ink can be maintained all the time.

When it is needed to print, pneumatic is applied to the reservoir ink tank by a pneumatic tank (air pressure generation pump), by which ink is transferred to the printer head and is injected on a printing object via nozzles. A small level of negative pressure (lower than atmospheric pressure) is applied to the reservoir ink tank so as to prevent the dropping of ink by means of gravity at usual time before or after printing.

The ink jet printer needs four color inks of black color ink K, blue color ink C, red color ink M, and yellow color ink Y. In the industrial printer, in case of a printing object such as a wooden plate, color distortion phenomenon might occur due to the pattern of tree. In this case, it is preferred that the base is made white using white color ink W before printing. In order to enhance adhesion force of ink on the printing object, a primer solution is coated on the printing object before printing, and a coating solution like primer solution is coated to enhance durability, discoloring and color preservation performance of the printing object.

The common industrial printer needs a washing liquid for washing dirt from the nozzle and ink leftover in the reservoir ink tank.

In the conventional printer, many color inks K, C, M, Y and W, primer solution, coating solution, washing liquid, etc. and pneumatic and negative pressure are needed to be transferred to the reservoir ink tank via each port, and in case of a two-head system, each port through which each ink is redistributed and inputted into the reservoir ink tank needs an opening and closing valve, so the conventional printer head has very complicated connection constructions.

The conventional industrial ink jet printer is configured like all ink tanks and tanks are directly connected with the reservoir ink tank, due to which the constructions are very complicated, and when such connections are made wrong mistakenly, a critical damage might be given to a high expensive printer head. Since each element of the conventional printer is directly connected, the volumes and weights of connection lines, control valves and negative chamber systems should fast and precisely move along the three-dimensional axes X, Y and Z in operation, which damages the printer head parts.

DISCLOSURE OF INVENTION

Accordingly, it is an object of the present invention to provide an input and output module which can be easily applied to an industrial ink jet printer by making both the lines connected with the reservoir ink tanks from each element of an industrial ink jet printer and the valves needed for controlling the lines simple and small-sized based on optimization, while overcoming the problems encountered in the conventional art.

To achieve the above objects, there is provided an ink jet printer module which supplies ink, washing liquid and pneumatic from a main ink tank, a washing liquid tank and a pneumatic tank to a reservoir ink tank connected with an ink jet printer head, which comprises a module body which forms an outer structure of the module; an ink inlet port, a washing liquid inlet port and a pneumatic inlet port which are provided at the module body and are connected with the main ink tank, the washing liquid tank and the pneumatic pump, respectively; an ink flow path, a washing liquid flow path, and a pneumatic flow path which are provided in the interior of the module body and communicate with the ink inlet port, the washing liquid inlet port and the pneumatic inlet port, respectively; a common flow path which is provided in the interior of the module body and selectively communicates with either the washing liquid flow path or the washing liquid flow path, so that the pneumatic and washing liquid can be selectively inputted; an ink opening and closing valve which is provided at the module body for controlling the opening and closing of the ink flow path; a pneumatic and washing liquid selection valve which is provided in the module body and controls either the pneumatic or the washing liquid to be selectively inputted into the common low path; an ink discharge port which is provided in the module body and discharges the ink of the ink flow path to the outside of the module body in accordance with a control of the ink opening and closing valve; and a common discharge port which is provided in the module body and discharges either the pneumatic or the washing liquid of the common flow path to the outside of the module body in accordance with a control of the pneumatic and washing liquid selection valve.

There is further provided a common valve for controlling either the pneumatic or washing liquid of the common flow path to be discharged to the outside of the module body by means of the common discharge port.

There is further provided a negative pressure chamber which is provided in the interior of the module body and is connected with the reservoir ink tank in order for the reservoir ink tank to receive negative pressure, the negative pressure chamber being connected with the common valve.

According to another embodiment of the present invention, it is preferred that the pneumatic opening and closing valve and the washing liquid opening and closing valve are one integrated three-way valve. Since two opening and closing functions can be obtained by one valve, the construction might be made simpler.

According to another embodiment of the present invention, it is preferred that the pneumatic/washing liquid discharge valve and the negative pressure opening and closing valve are one integrated three-way valve. Since two opening and closing functions can be obtained by one valve, the number of valves can be advantageously reduced by as many as the number of four ink inlet ports and the number of the primer solution, the coating solution and the white ink.

The ink jet printer module according to the present invention further comprises either a primer solution inlet port or a coating solution inlet port into which primer solution or coating solution are inputted; either a primer solution opening and closing valve or a coating solution opening and closing valve for controlling the flow of either the primer solution or the coating solution; and a discharge port for discharging either the primer solution or the coating solution. In addition, the module comprises a primer solution inlet port and a coating solution inlet port which communicate with each other and selectively transfers the solution via one opening and closing valve.

The ink jet printer module according to the present invention further comprises a white ink inlet port for inputting white ink; an opening and closing valve for controlling the flow of the white ink; and a white ink discharge port. In addition, the module might further comprises a white ink feedback port which communicates with the white ink inlet port for feed backing the white ink to the white ink tank; and a feedback opening and closing valve for controlling the communication. The white ink, which is mainly used, might be precipitated when it is not used for long time, so its physical characteristic might go bad. The white ink can periodically circulate according to the present invention, which results extending its service life.

The ink jet printer module according to the present invention further comprises a second negative pressure opening and closing valve for controlling the opening and closing between the negative pressure chamber and the negative pressure pump. A sensor is further provided for measuring the pressure of the negative pressure chamber. A negative pressure decrease opening and closing valve is further provided, which operates in cooperation with the sensor and controls the input of an external air when over negative pressure occurs at the negative pressure chamber.

The module according to the present invention further comprises a discharge port for discharging the liquid inputted into the negative pressure chamber due to an error operation, and a means is further provided for detecting the input of solution is provided in the interior of the negative pressure chamber.

In the ink jet printer module according to the present invention, the module body comprises a first unit; a second unit; and a third unit, and wherein an ink flow path, a pneumatic flow path, a washing liquid flow path, a pneumatic and washing liquid selection flow path are formed at an engaging surface between the first unit and the second unit, and wherein a negative pressure chamber is formed at an engaging surface between the second unit and the third unit.

The module body comprises a first unit; a second unit; and a third unit, and wherein an ink flow path, a pneumatic flow path, a washing liquid flow path, a pneumatic and washing liquid selection flow path and a negative pressure chamber are formed at an engaging surface between the first unit and the second unit.

The module body comprises a first unit; a second unit; and a third unit, and wherein an ink flow path, a pneumatic flow path, a washing liquid flow path and a pneumatic and washing liquid selection flow path are formed at an engaging surface between the first unit and the second unit, and wherein a negative pressure chamber is formed at an engaging surface between the first unit, the second unit and the third unit.

Advantageous Effects

In the ink jet printer module according to the present invention, all connections of the system are made integral in the module, and the input and output ports can be easily connected with other element of the printer, respectively. Less experienced worker can easily install or uninstall the module at the printer, and at least two flow paths are integrated into one flow path, according to which the number of necessary control valves can be significantly reduced, thus reducing manufacture cost and process. The negative chambers are internally optimized, which leads to smaller size construction as compared to the conventional art. The present invention can be easily applied to various sizes of industrial printers.

BRIEF DESCRIPTION OF THE DRAWINGS

The present invention will become better understood with reference to the accompanying drawings which are given only by way of illustration and thus are not limitative of the present invention, wherein.

MODES FOR CARRYING OUT THE INVENTION

The present invention will be described with reference to the accompanying drawings. It is obvious that the disclosure of the drawings is not limited thereto.

As shown in FIG. 16, the ink jet printer 10 comprises a printer body 11, a carriage device 20 which is movable along an upper side of the printer body 11, and a carriage device guide 12 for guiding the movement of the carriage device 20.

Figure 1:
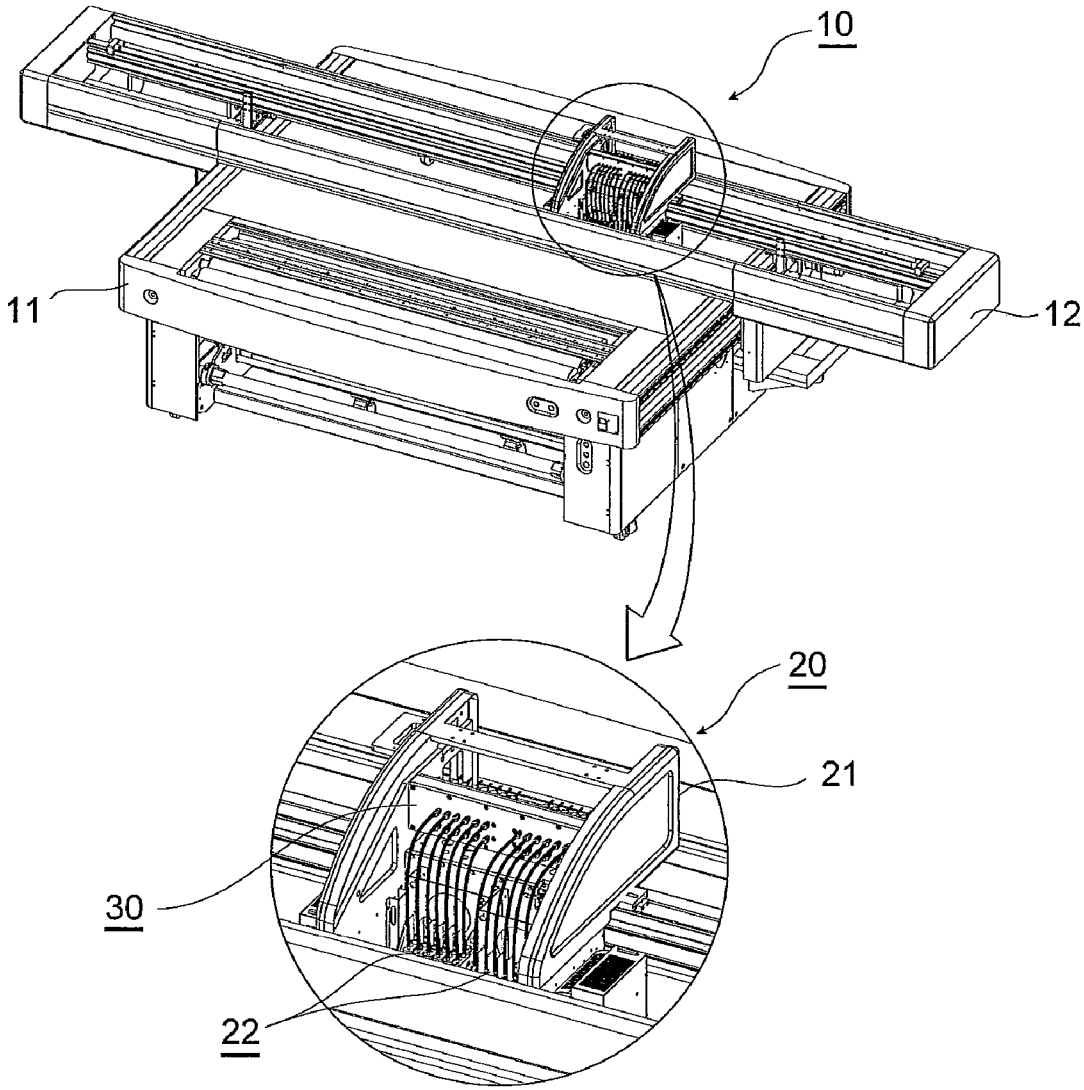
FIG. 1 is a perspective and partially enlarged view illustrating a printer equipped with an ink jet printer module according to the present invention.
Figure 2:
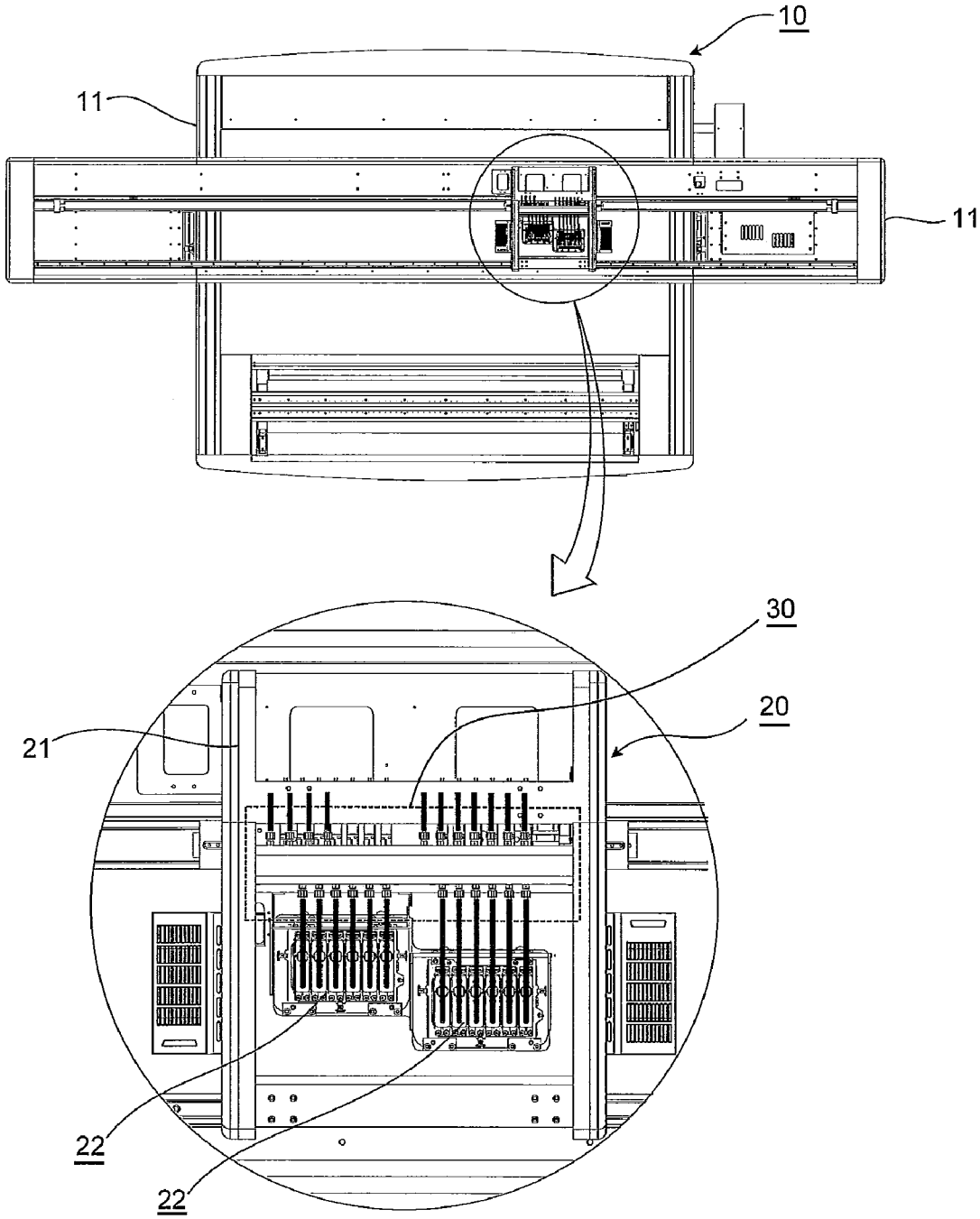
FIG. 2 is an upper side and partially enlarged view of the printer of FIG. 1.

As shown in FIGS. 1 and 2, the carriage device 20 comprises a carriage body 21 forming an outer structure of the carriage device 20, an ink jet printer module 30 provided at the carriage body 21, and a reservoir ink tank unit 22 connected with the ink jet printer module 30.

Figure 3:
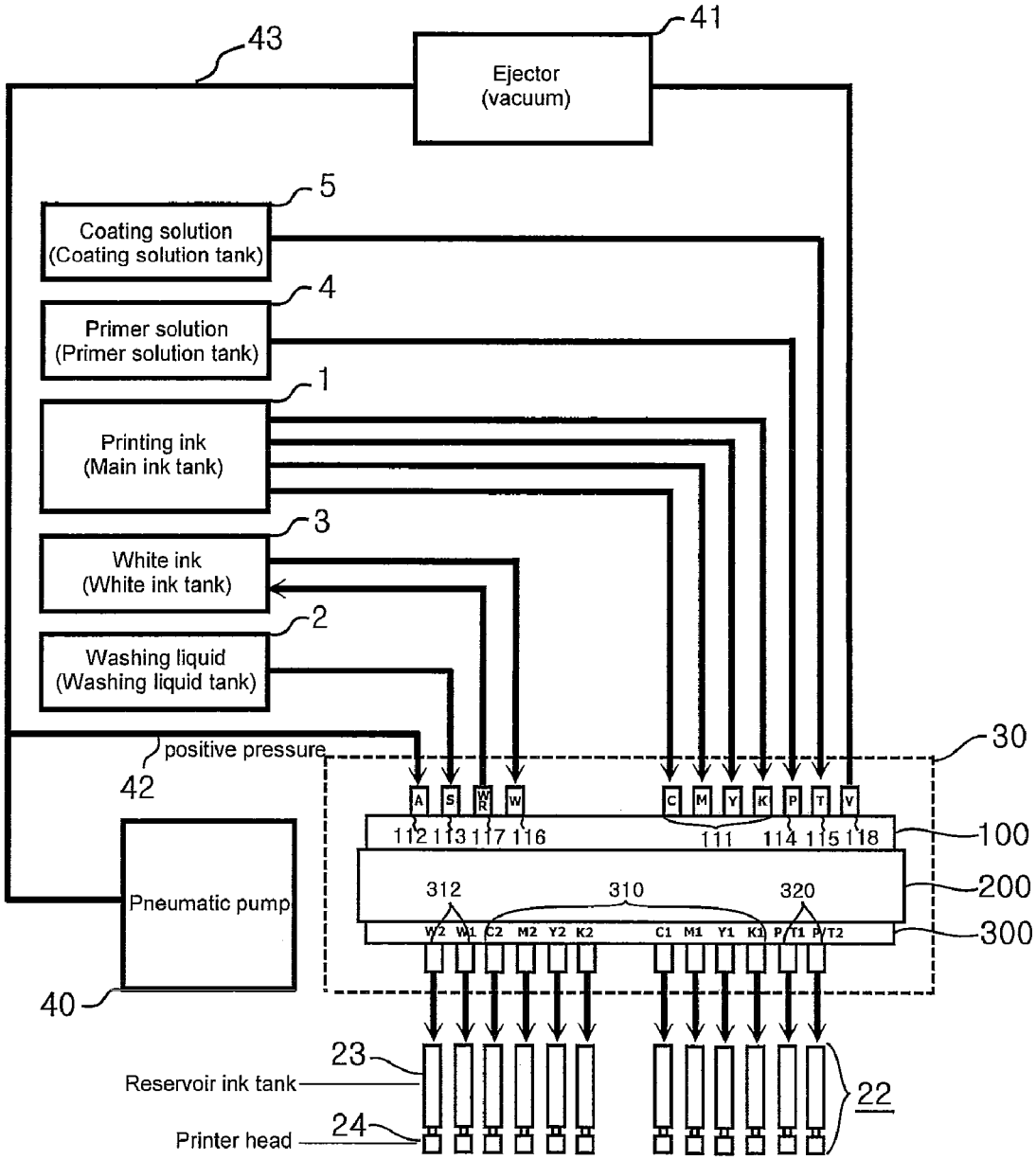
FIG. 3 is a view illustrating an external flow system connected with other elements of a printer with an ink jet printer module according to the present invention.

As shown in FIGS. 2 and 3, the reservoir ink tank unit 22 comprises a reservoir ink tank 23 connected with the ink jet printer module 30, and a printer head 24 connected with the reservoir ink tank 23. Here, one or more reservoir ink tank unit 22 might be provided, and as shown in FIGS. 2 and 3, two reservoir ink tank units 22 are preferably provided.

As shown in FIG. 3, the ink jet printer module 30 comprises a coating solution tank 5 for storing coating solution, a primer solution tank 4 for storing primer solution, a main ink tank 1 for storing ink, a white ink tank 3 for storing white ink, a washing liquid tank 2 for storing washing liquid, and inlet ports 115, 114, 111, 116 and 113. The liquid tanks 5, 4, 1, 3 and 2 might be connected with the inlet ports 115, 114, 111, 116 and 113, respectively. It is obvious that the above construction is just one example, which is not limited thereto.

The coating solution, primer solution, ink, white ink, and washing liquid might be supplied to the ink jet printer module 30, respectively, via the inlet ports 115, 114, 111, 116 and 113. A white color ink feedback port 117 might be further provided to allow the white ink to go back to the white ink tank 2 so as to prevent the white ink from being discolored.

As shown in FIG. 3, the ink jet printer module 30 comprises a pneumatic pump 40, and inlet ports 112 and 118 connected with an ejector 41. Here, the pneumatic pump 40 is connected with the inlet port 112, 118 by means of a first line 42 and a second line 43 having the ejector 41, respectively.

The pneumatic, positive pressure, might be supplied to the ink jet printer module 30 or the ink jet printer module 30 might generate negative pressure.

As shown in FIGS. 3 and 6, the ink jet printer module 30 comprises ports 320-, 310, 312 and 260 connected with a reservoir ink tank unit 22, respectively. Here, the reservoir ink tank unit 22 and the ports 320, 310, 312 and 260 might be connected via hoses (not shown). It is obvious that the above connections are not limited thereto.

The coating solution, primer solution, ink, white ink, washing liquid and pneumatic might be discharged from the ink jet printer module 30 to the reservoir ink tank 23 of the reservoir ink tank unit 22 via the ports 320, 310, 312 and 360, respectively. The negative pressure might be applied to the reservoir ink tank 23. The negative pressure prevents the ink from dropping in the direction of gravity.

As shown in FIGS. 3 through 6, the flows of the liquid and air in the ink jet printer module 30 will be described. It is obvious that the following descriptions are provided as one example, not limiting thereto. Since the flows of the ink, primer and coating solutions and white ink are similar with one another, so the flow of the ink of the main ink tank 1 will be described as one representative. The operations of the supplies of the washing liquid and pneumatic and the application of negative pressure can be selectively performed, so all the operations will be described together.

Figure 4:
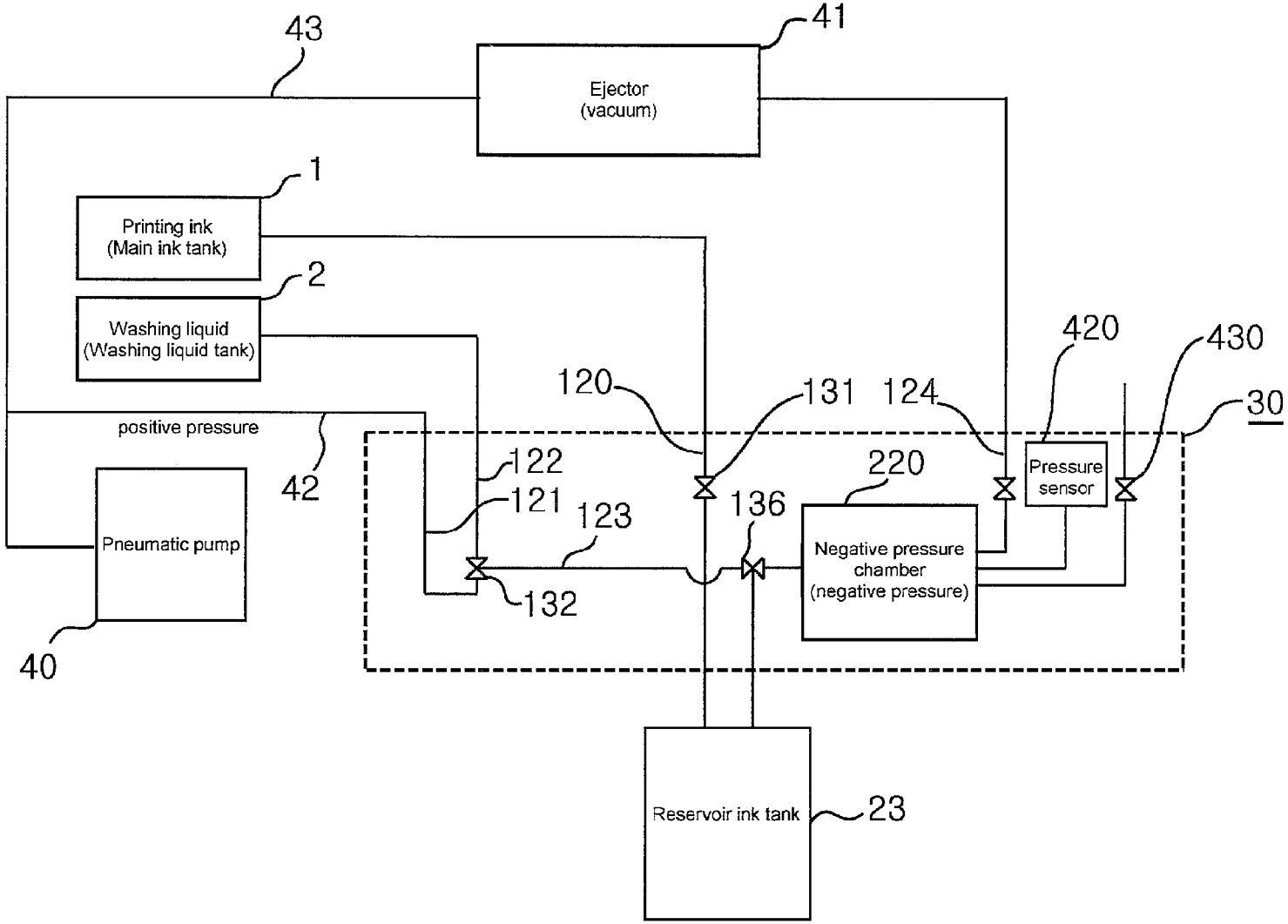
FIG. 4 is a view illustrating an internal flow system operating in the interior of the module according to the present invention.
Figure 5A:
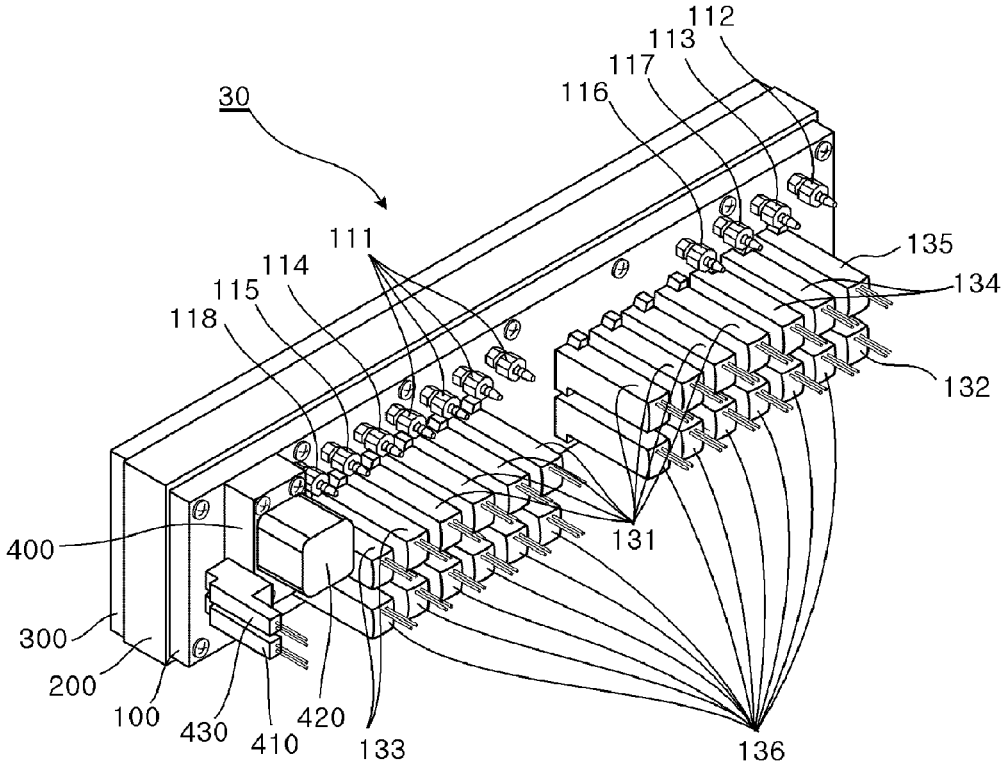
FIG. 5 is a perspective illustrating an engagement of an ink jet printer module according to an embodiment of the present invention, of which (A) is an input part, and (b) is an output part.
Figure 5B:
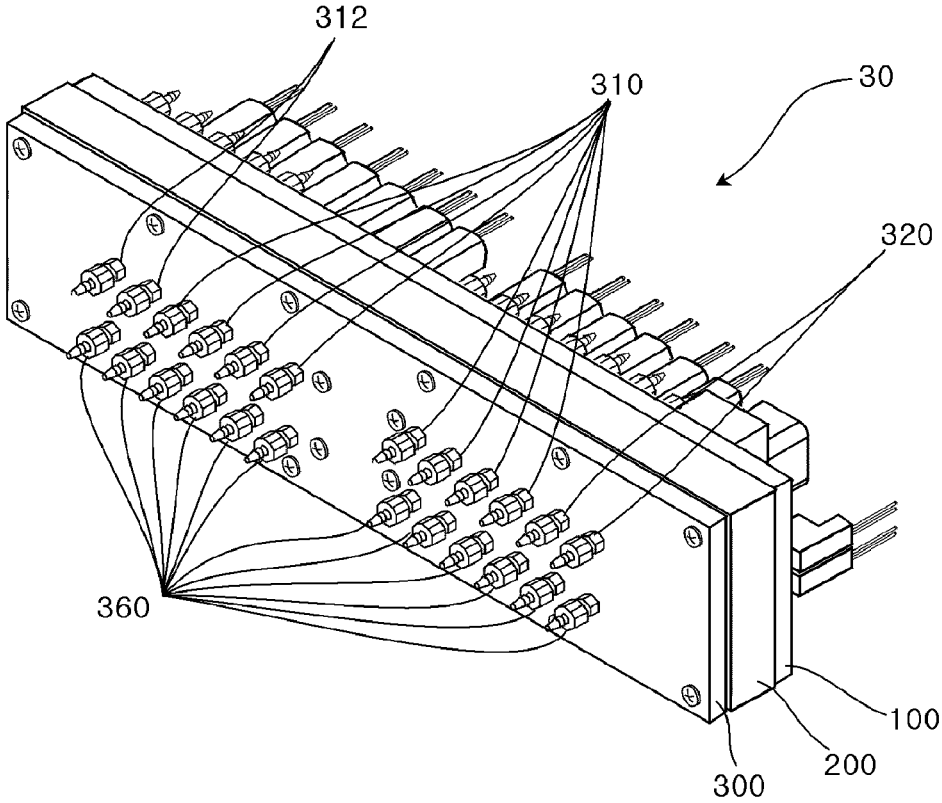
Figure 9:
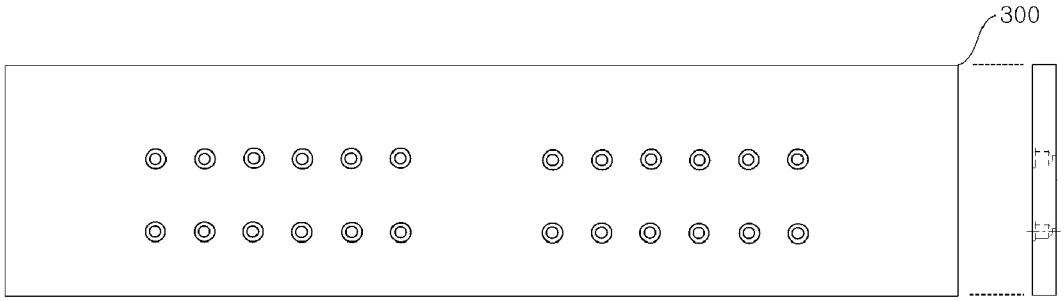
FIG. 9 is a cross sectional view illustrating a third unit of FIG. 6.

The blue ink C, red ink M, yellow ink Y, and block ink K of the main ink tank 1 of FIGS. 3 and 4 are inputted into the ink jet printer module 30 via the inlet ports C, M, Y, K and 111, and the flows are divided by the ink flow path 120 of FIG. 9 provided in the ink jet printer module 30 and pass through the ink opening and closing valve 131 of FIGS. 4 and 5, respectively, and are discharged to the ports C1, C2, M1, M2, Y1, Y2, K1, K2 and 310 of FIGS. 3 and 6 and are supplied to the reservoir ink tanks C1, C2, M1, M2, Y1, Y2, K1, K2 and 23 of two reservoir ink tank units 22 of FIG. 3.

The washing liquid of the washing liquid tank 2 of FIGS. 3 and 4 is inputted into the interior of the ink jet printer module 30 via the inlet port 113 of FIGS. 3 and 5, and is inputted into the common flow path 123 of FIG. 9 provided in the interior of the ink jet printer module 30 via the washing liquid flow path 122 of FIG. 9 provided in the interior of the ink jet printer module 30 and the pneumatic and washing liquid selection valve 132 of FIGS. 4 and 5, and is discharged to the common discharge port 360 of FIG. 6 via the common valve 136 of FIGS. 4 and 5 and is finally supplied to the reservoir ink tanks C1, C2, M1, M2, Y1, Y2, K1, K2, P/T1, P/T2, W1, W2 and 23 of two reservoir ink tank unit 22 of FIG. 3, respectively.

The pneumatic generated by the pneumatic pump of FIGS. 3 and 4 is applied as positive pressure into the interior of the ink jet printer module 30 via the inlet port 112 of FIGS. 3 and 5, and is applied into the common flow path 123 of FIG. 9 provided in the interior of the ink jet printer module 30 via the pneumatic flow path 12 of FIG. 9 provided in the interior of the ink jet printer module 30 and the pneumatic and washing liquid selection valve 132 of FIGS. 4 and 5, and is discharged to the common discharge port 360 of FIG. 6 via the common valve 136 of FIGS. 4 and 5, and is finally supplied to the reservoir ink tanks C1, C2, M1, M2, Y1, Y2, K1, K2, P/T1, P/T2, W1, W2, 23 of two reservoir ink tank units 22 of FIG. 3. Here, the washing procedure is performed after the supply of the washing liquid is finished.

Figure 8:
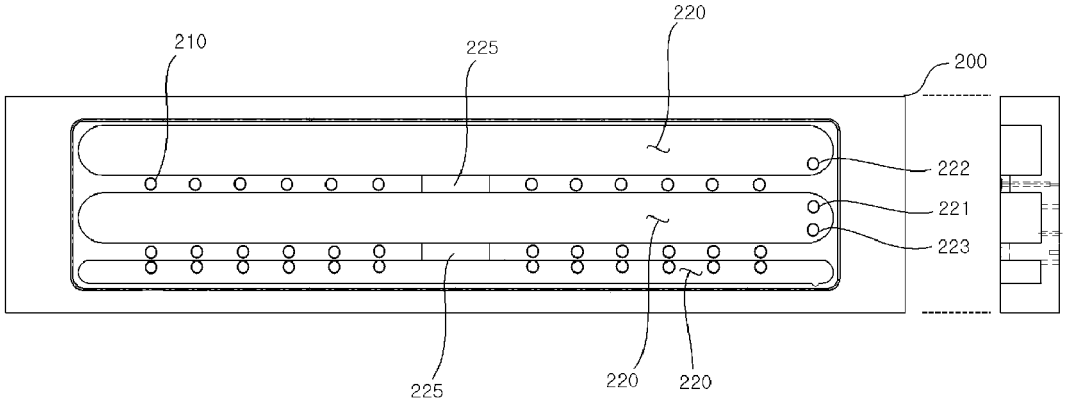
FIG. 8 is a cross sectional view illustrating a second unit of FIG. 6.

The negative pressure of FIGS. 3 and 4 means the pressure applied in the opposite direction to the positive pressure of FIGS. 3 and 4. The pneumatic pump 40 of FIGS. 3 and 4, the ejector 41 of FIGS. 3 and 4, the inlet port 118 of the ink jet printer module 30, and the negative chamber 220 of FIGS. 4 and 8 provided in the interior of the ink jet printer module 30 are connected with one another, and the negative pressure chamber 220 is connected with the common valve 136 of FIGS. 4 and 5, the common discharge port 360 of FIG. 6, the reservoir ink tanks C1, C2, M1, M2, Y1, Y2, K1, K2, P/T1, P/T2, W1, W2, and 23 of two reservoir ink tank units 22 of FIG. 3 are connected, so the negative pressure is applied to the reservoir ink tanks C1, C2, M1, M2, Y1, Y2, K1, K2, P/T1, P/T2, W1, W2 and 23, respectively.

The construction of the ink jet printer module 10 according to the present invention will be described in details.

As shown in FIGS. 5 through 8, the ink jet printer module 10 comprises module bodies 100, 200, and 300 forming an outer structure of the module, inlet ports 112, 113, 117, 116, 11, 114, 115, and 118 engaged at the module bodies 100, 200 and 300, valves 135, 134, 131, 133, 132, and 136 engaged at the module bodies 100, 200 and 300, discharge ports 312, 310 and 320 engaged at the module bodies 100, 200 and 300, a common discharge port 360 engaged at the module bodies 100, 200 and 300, a communication unit 400 engaged at the module bodies 100, 200 and 300, while communicating with the module bodies, a pressure sensor 420 engaged at the communication unit 400, while communicating with the pressure sensor 420, an opening and closing valve 410 which communicates with the communication unit 400 and the module bodies 100, 200 and 300, respectively, and an atmosphere pressure opening and closing valve 430 which communicates with the communication unit 400 and the module bodies 100, 200 and 300, respectively.

The module bodies 100, 200 and 300 of the ink jet printer module 10 each comprise a first unit 100, a second unit 200 and a third unit 300.

The inlet ports 112, 113, 117, 116, 111, 114, 115 and 118 of the first unit 100 are to receive the solution and air into the interior of the ink jet printer module 10 from the outside and are installed at an upper row of the first unit 100.

As shown in FIG. 5, the inlet ports 112, 113, 117, 116, 111, 114, 115 and 118 each comprise an ink inlet port 111 for receiving ink, a washing liquid inlet port 113 for receiving washing liquid, a primer solution inlet port 114 for receiving primer solution, a coating solution inlet port 115 for receiving coating solution, a white ink inlet port 116 for receiving white ink, a white ink feedback port 117 for returning back the ink to the white ink tank 3, and a negative pressure inlet port 118 to which negative pressure is applied when the air is discharged.

It is obvious that the constructions of the inlet ports 112, 113, 117, 116, 111, 114, 115 and 118 are not limited thereto, and any constructions having the same functions as the above inlet ports might be used. As shown in the drawings, the inlet ports 112, 113, 117, 116, 111, 114, 115 and 118 of the first unit 100 might be formed in such a manner that the through holes are formed at the first unit 100 by using a drill machine, and the inner sides of the inlet ports 112, 113, 117, 116, 111, 114, 115, 115 and 118 are tapped to form nut grooves, and the connection nipples are engaged to the nut grooves, and the engaging bolts are engaged to the connection nipples, respectively. It is obvious that the above method is not limited thereto.

As shown in FIG. 9, the first unit 100 comprises flow paths 121, 122, 127, 128, 120, 124, 125, and 126 communicating with the ink inlet port 111, the pneumatic inlet port 112, the washing liquid inlet port 113, the primer solution inlet port 114, the coating solution inlet port 115, the white ink inlet port 116, the white ink feedback port 117, and the negative inlet port 118, respectively. The common flow path 123 for selectively allowing the washing liquid and pneumatic to flow is further formed. The constructions of the flow paths 121, 122, 127, 128, 120, 124, 125, 126 and 123 are not limited thereto. Any construction having the same functions as the above flow paths might be applied for the same purpose.

The flow paths will be described in details with reference to FIG. 9.

As shown in FIG. 9, the flow paths 121, 122, 127, 128, 120, 124, 125 and 126 are formed of the pneumatic flow path 1321, the washing liquid flow path 122, the white ink feedback flow path 127, the white ink flow path 128, the ink flow path 120, the primer solution flow path 124, the coating solution path 125, and the negative pressure flow path 126. There is further provided a common flow path 123 which is selectively connected with the pneumatic flow path 121 and the washing liquid flow path 122 for thereby selectively receiving washing liquid and pneumatic.

The pneumatic flow path 121 is a flow path connected from a position (a) where the pneumatic inlet port 112 is installed, to a position (b) where the pneumatic and washing liquid selection valve 132 is installed. As shown in FIG. 13, the air introduced via the pneumatic inlet port 112 moves to the common flow path 123 via the pneumatic flow path 121 and the pneumatic and washing liquid selection valve 132. Since the air flown to the common flow path 123 is discharged via the common valve 136 and the common discharge port 360.

The washing liquid flow path 122 is a flow path connected from a position (a) where the washing liquid inlet port 113 is installed, to a position (b) where the pneumatic and washing liquid selection valve 132 is installed. As shown in FIG. 13, the washing liquid introduced via the washing liquid inlet port 113 moves to the common flow path 123 via the washing liquid flow path 122 and the pneumatic and washing liquid selection valve 132, and since the common flow path 123 is positioned at a position (c) where the common discharge port 360 is installed, the washing liquid moved to the common flow path 123 is discharged via the common valve 136 and the common discharge port 360.

Since the pneumatic and washing liquid inputted into different ports 112 and 113 can selectively flow through one common flow path 123, namely, either the washing liquid can flow through the common flow path 123 depending on the pneumatic and washing liquid selection valve 132, which is a three-way valve, or the pneumatic can flow through the common flow path 123, so the number of the valves can reduce.

Either the pneumatic or the washing liquid inputted into different ports 112 and 113 can use the common discharge port 360, namely, either the washing liquid can flow through the common discharge port 360 depending on the pneumatic and washing liquid selection valve 132, which is a three-way valve, or the washing liquid can flow through the common discharge port 360, so the dimension of the module can reduce, and the manufacture is easy.

The ink introduced into the ink inlet port 111 moves to a set position via the ink flow path 120, and each ink flow path is divided into two parts for the output toward two heads, and the ink flows to the second unit 200 via the ink opening and closing valve 131 and is discharged to the reservoir ink tank via the third unit 300.

The primer solution, the coating solution and the white ink flow in the same manner as the common flow method of the ink. Another feature of the present invention lies in that the flow paths 124 and 125 of the primer solution and the coating solution are made communicated with each other, and one flow path can share the primer solution and the coating solution by controlling the opening and closing valve 133. If necessary, the primer solution and the coating solution can be moved to two heads (two primer solution heads or two coating solution heads), thus obtaining two times faster process.

Another feature of the present invention lies in that there are provided a feedback port 117 and a feedback opening and closing valve 135 which help feed back the white ink to the white ink tank for mixing the white ink again since the white ink might be precipitated and go bad when the printer is not used for log time.

Figure 6A:
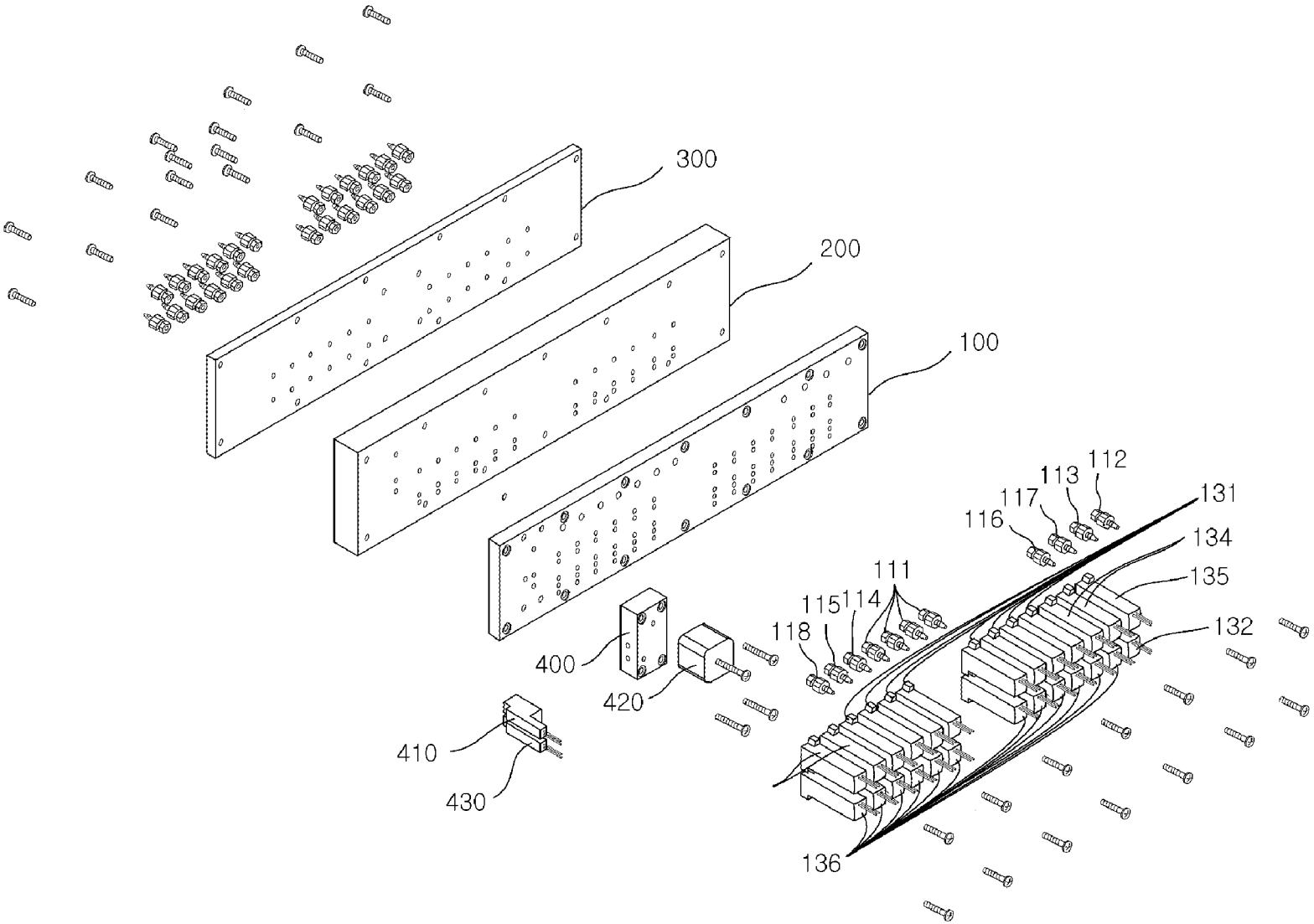
FIG. 6 is a disassembled perspective view illustrating the module of FIG. 5.

Since the first unit is equipped with the flow path groove, the engaging surface of the second unit might have a flow path groove, but might not have the same as shown in FIG. 6A. Now shown in the drawings, if the second unit has the flow path groove, the first unit might not have the flow path groove.

The ink, white color ink, primer solution and coating solution, which have passed through the opening and closing valves 131, 133 and 134 of the first unit are discharged to each reservoir ink tank through the ink discharge port 310, the primer and coating solution discharge ports 311, and the white ink discharge port 312 along the through hole 210 formed at the intermediate portion of the second unit, respectively.

Figure 6B:
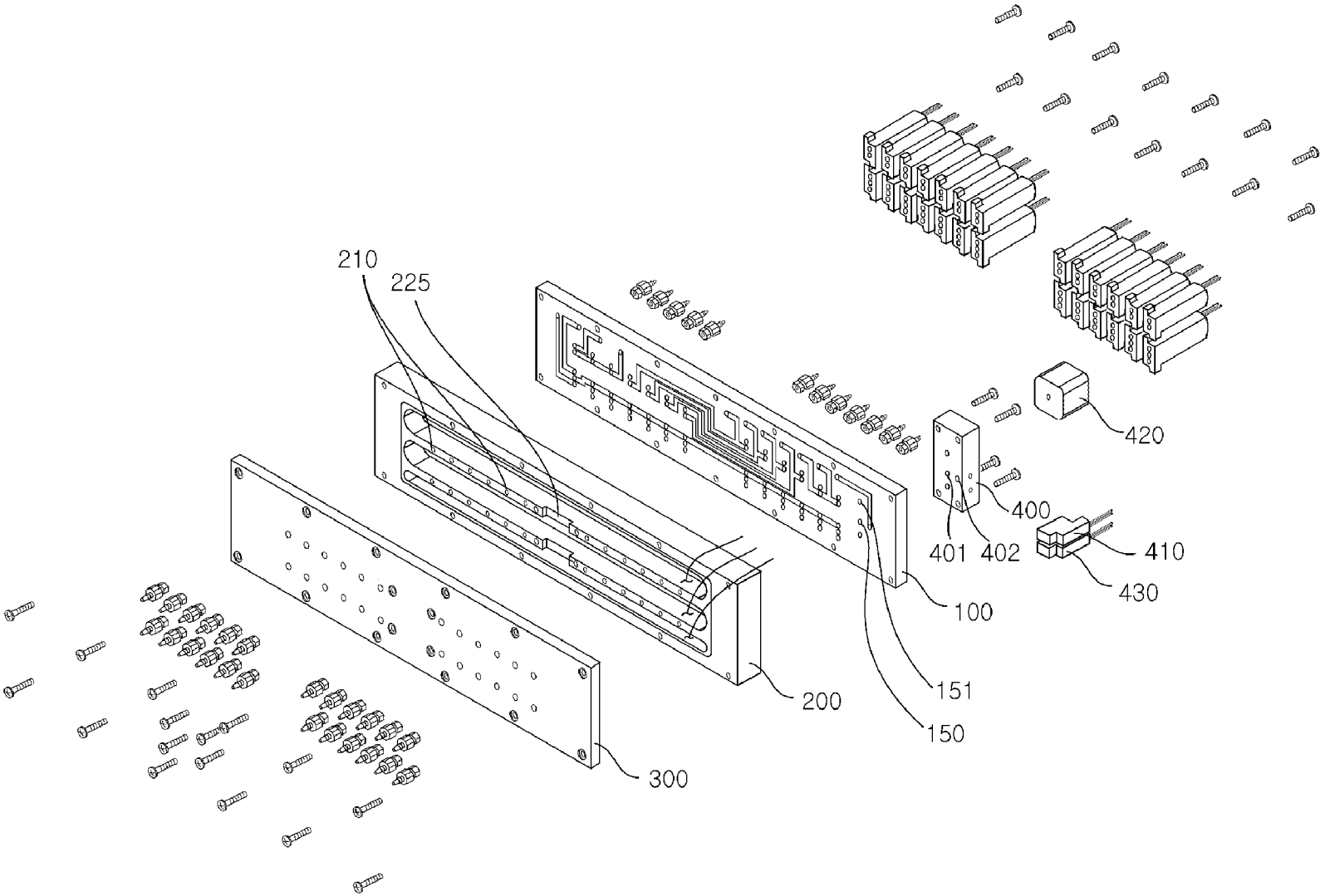
Figure 7:
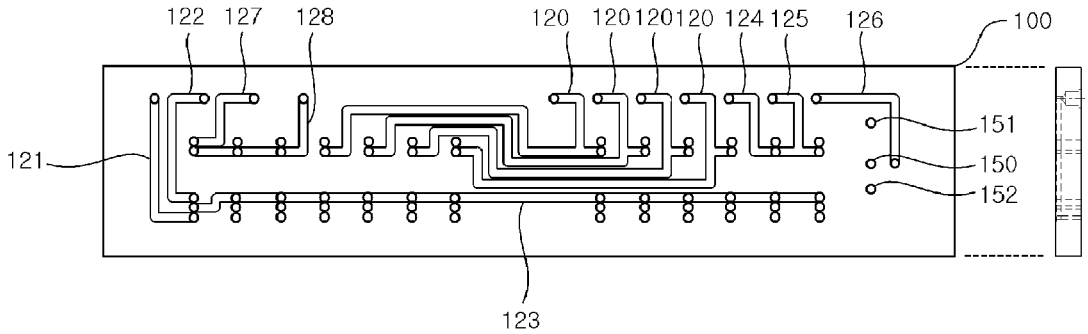
FIG. 7 is a cross sectional view illustrating a first unit of FIG. 6.

In the embodiment of the present invention, the second unit is connected with the third unit, thus forming a negative pressure chamber 220. As shown in FIG. 6B, a negative pressure chamber is formed at the upper portion, the intermediate portion and the lower portion in order to form efficient negative pressure chambers, which communicate with one another in a communication structure 225.

A pressure sensor is provided in each negative pressure chamber in order to measure negative pressure. When the negative pressure exceeds a set error range, the pressure sensor detects the exceeding range and transfers to the controller of the printer, thus adjusting the atmospheric pressure opening and closing valve connected with the negative pressure chamber and maintaining the negative pressure to remain within the error range. The pneumatic passes through one three-way valve and is discharged to the reservoir ink tank via another three-way valve.

The third unit is to form a negative pressure chamber in relation with the second unit. As shown in FIG. 5, the ink discharge port 310, the primer and coating solution discharge port 311, the white ink discharge port 312 are provided at the upper side of the third side of the third unit, and the pneumatic, washing liquid and negative pressure selection port 312 is provided at the lower side of the third unit.

The opening and closing valves of the present invention are fixedly installed at an outer surface of the first unit, and the input and output are performed to the opening and closing valve through the through holes 119, 140, 141, 142 and 143 formed at the first unit.

The negative pressure passes through the second negative pressure communication hole 221 formed in the negative pressure chamber and the first negative pressure communication hole 150 formed at the first unit 100 and then passes through the second negative pressure opening and closing valve 410 fixedly installed at the fourth unit 400 and is finally applied to the negative pressure pump via the negative pressure inlet port 118, flowing along the negative pressure flow path 124 of the first unit.

The negative pressure chamber communicates with the pressure sensor 420 via the sensor connection hole 222 of the second unit and the sensor connection hole 151 of the first unit, thus detecting the negative pressure, so the negative pressure can maintain within an error range.

When an over negative pressure is applied to the negative pressure chamber, the atmospheric pressure opening and closing valve 430 formed at the fourth unit 400 is open, and the atmospheric pressure is inputted into the negative pressure chamber through the first atmospheric pressure connection hole 152 of the first unit and the second atmospheric pressure connection hole 223 of the second unit, respectively.

Figure 10A:
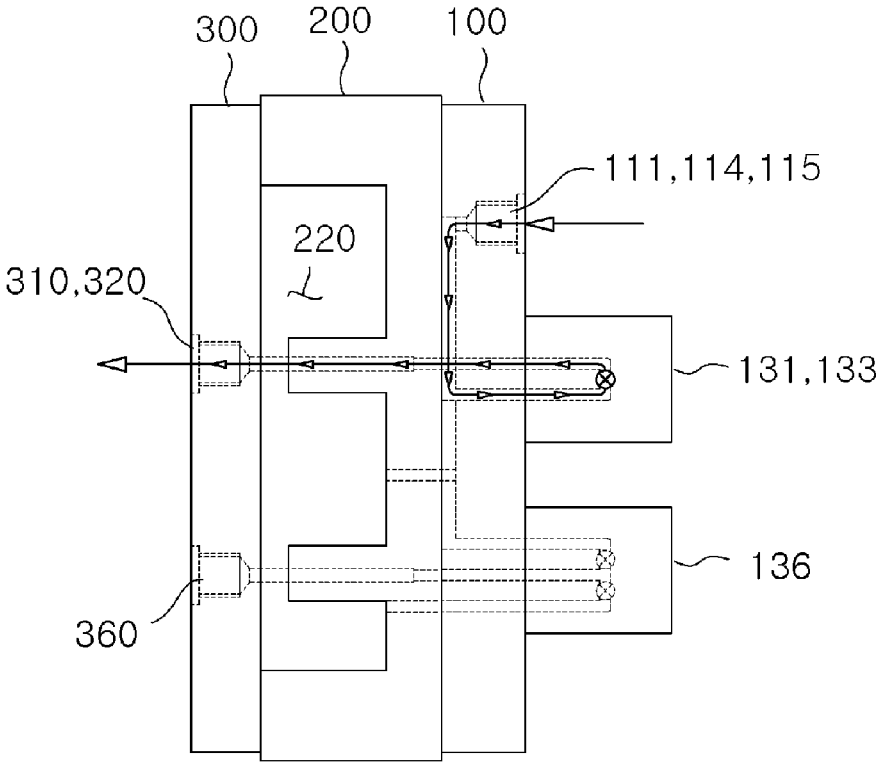
FIG. 10 is a view illustrating an ink/primer solution/coating solution/white color ink flow path (FIG. 10A), pneumatic/washing liquid flow path (FIG. 10B), and negative pressure flow path (FIG. 10C) (second negative pressure opening and closing valve is omitted) of the module of FIG. 8.
Figure 10B:
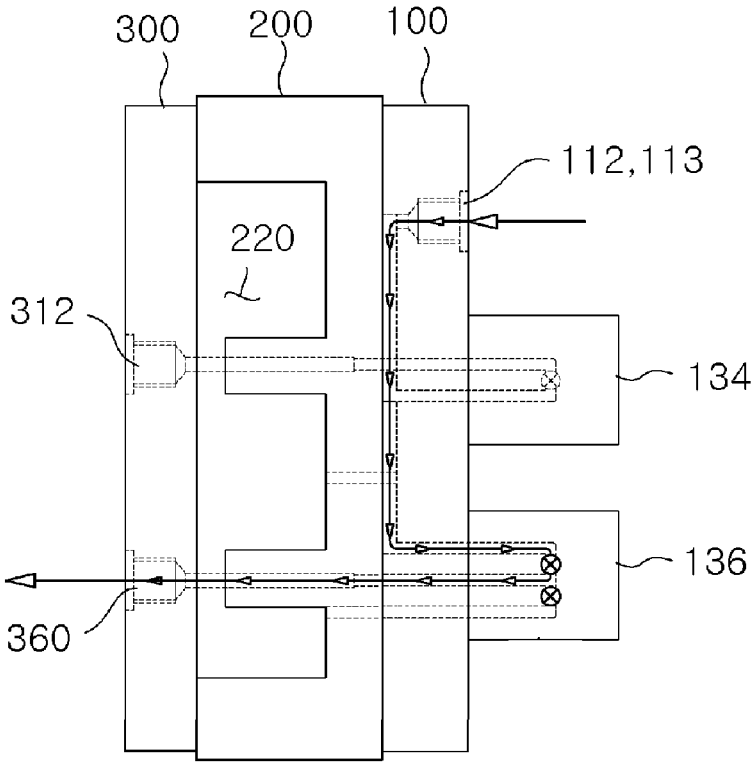
Figure 10C:
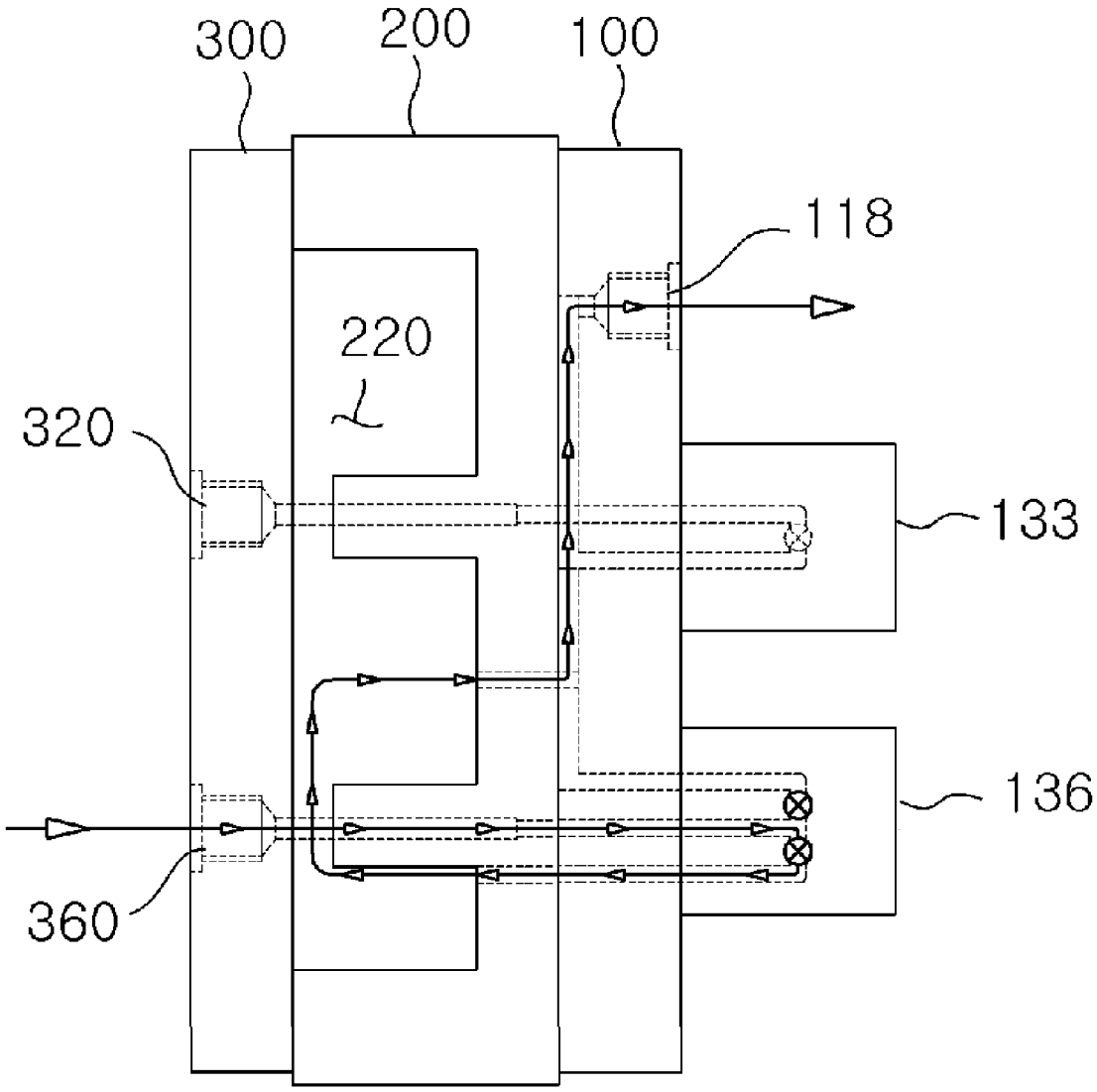

FIG. 10 is a view illustrating the ink/primer solution/coating solution/white ink flow path (FIG. 10A), the pneumatic and washing liquid flow path (FIG. 10B), and the flow path of the negative pressure (FIG. 10C: the second negative pressure opening and closing valve is omitted) of the module of FIGS. 5 and 6.

As shown in FIGS. 10A and 10B, the pneumatic and washing liquid discharge valve comprises a three-way valve (pneumatic, washing liquid, and negative pressure selection valve 136) integrated with the negative pressure generation valve.

Figure 11:
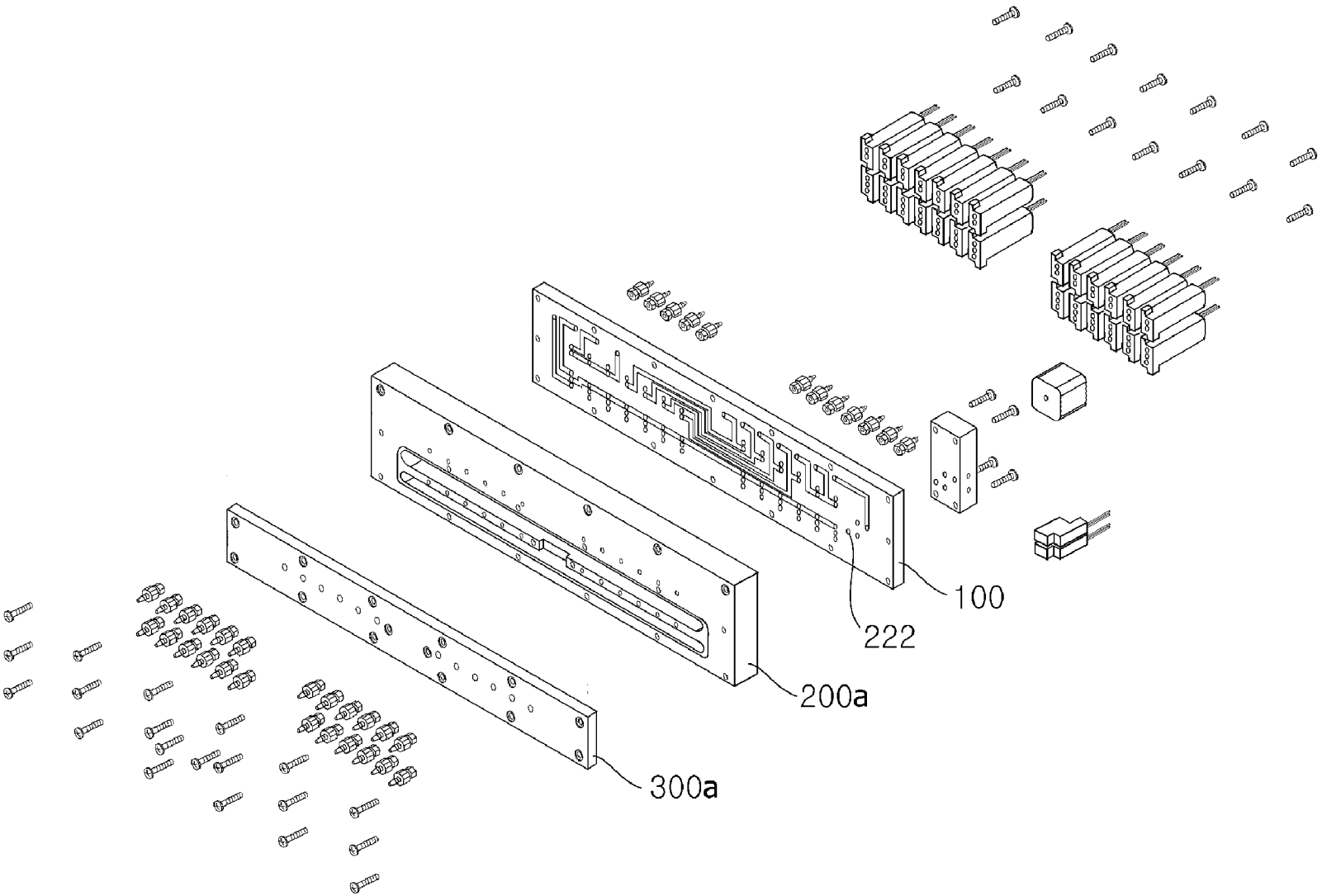
FIG. 11 is a disassembled perspective view illustrating an ink jet printer module according to another embodiment of the present invention.
Figure 12:
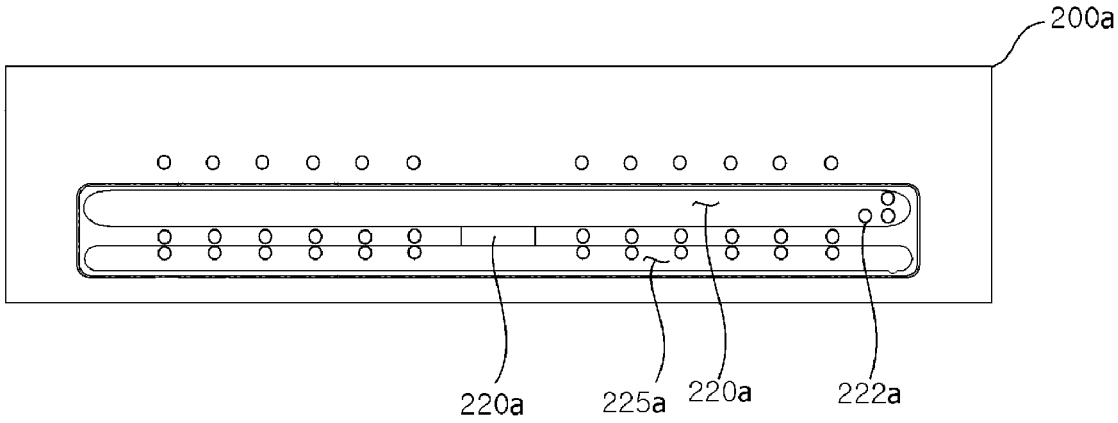
FIG. 12 is a cross sectional view illustrating a second unit of FIG. 11.
Figure 13A:
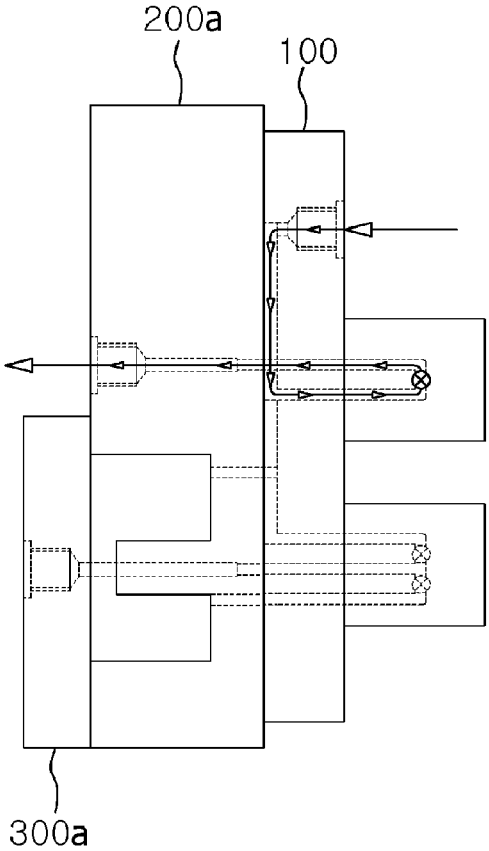
FIG. 13 is a view illustrating an ink/primer solution/coating solution/white color ink flow path (FIG. 13A), pneumatic/washing liquid flow path (FIG. 13B), and negative pressure flow path (FIG. 13C) (second negative pressure opening and closing valve is omitted) of the module of FIG. 11.
Figure 13B:
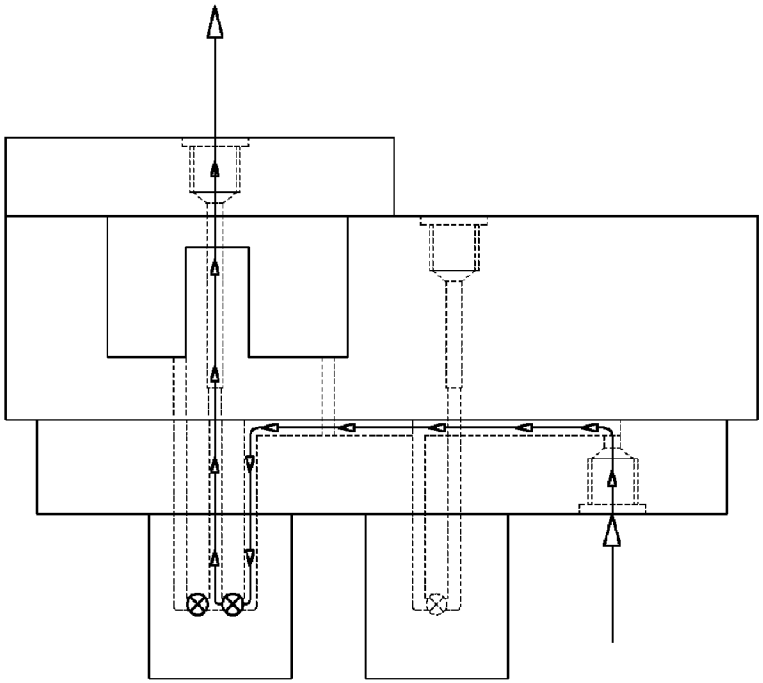
Figure 13C:
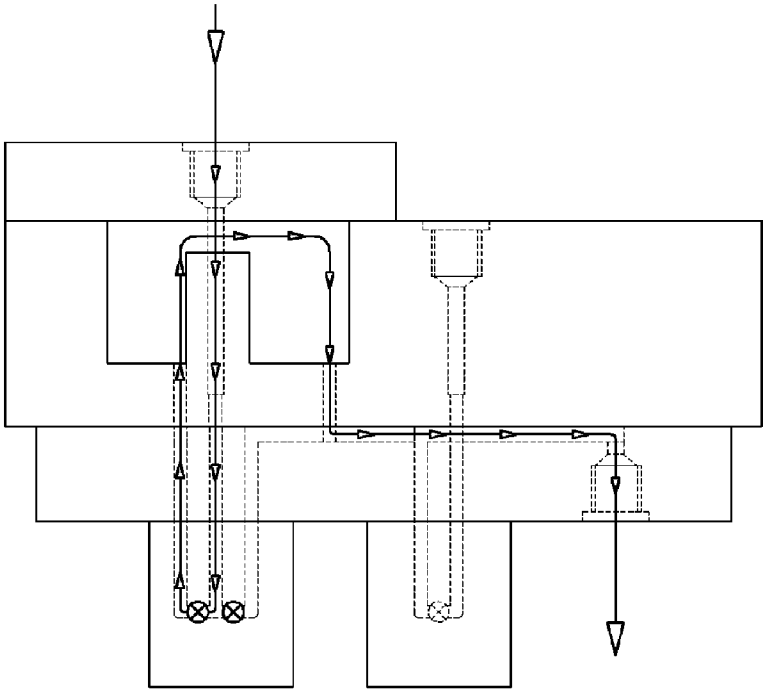

FIG. 11 is a disassembled perspective view illustrating an ink jet printer module according to another embodiment of the present invention, and FIG. 12 is a cross sectional view illustrating a second unit, and FIG. 13 is a view illustrating an ink/primer solution/coating solution/white color ink flow path (FIG. 13A), pneumatic/washing liquid flow path (FIG. 13B), and negative pressure flow path (FIG. 13C) (second negative pressure opening and closing valve is omitted) of the module of FIG. 11.

The difference as compared to the module of FIG. 6 lies in that the ink discharge port is formed at the second unit, not at the third unit. So, the pressure sensor of the negative pressure chamber is formed at the intermediate chamber where the upper chamber is not provided.

Figure 14:
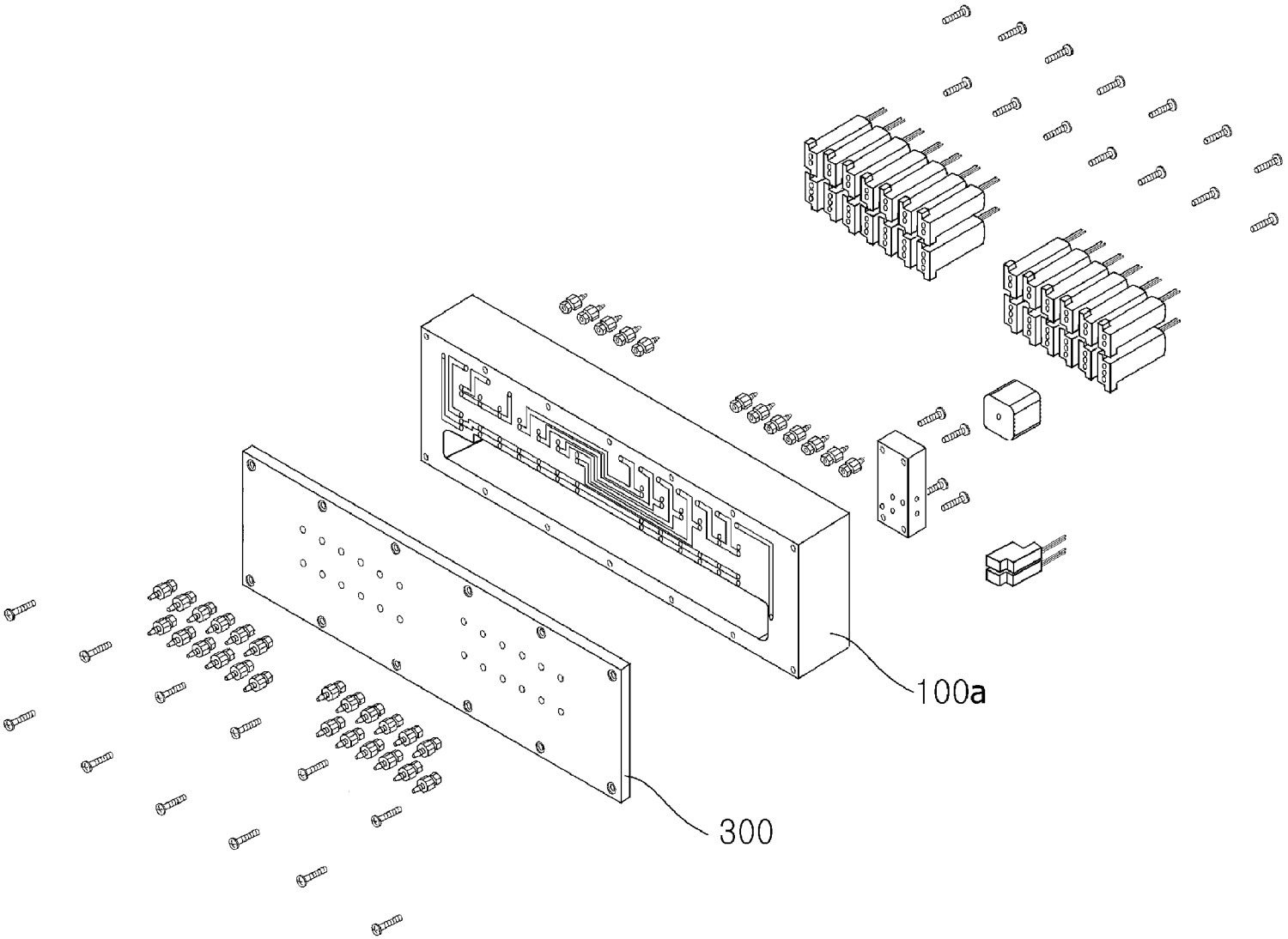
FIG. 14 is a disassembled perspective view illustrating an ink jet printer module according to further another embodiment of the present invention.
Figure 15:
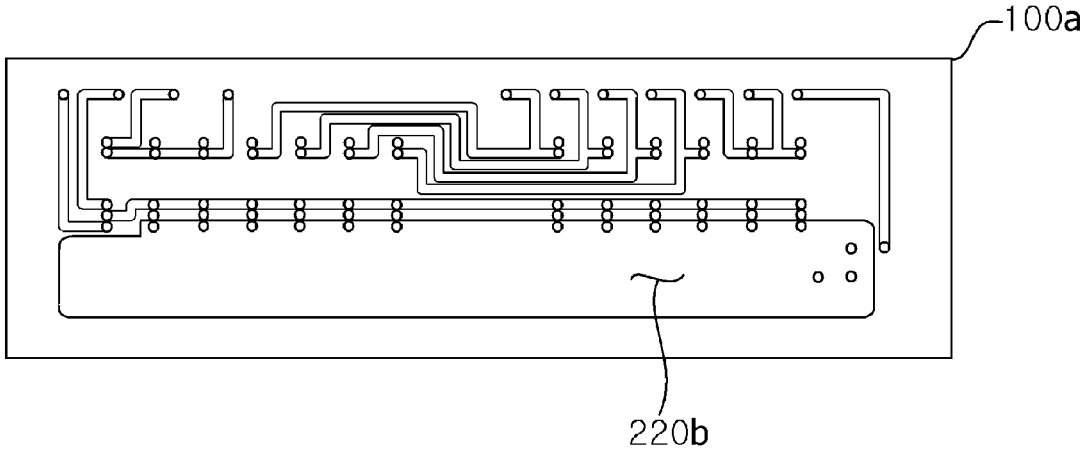
FIG. 15 is a cross sectional view illustrating a first unit of FIG. 14.
Figure 16A:
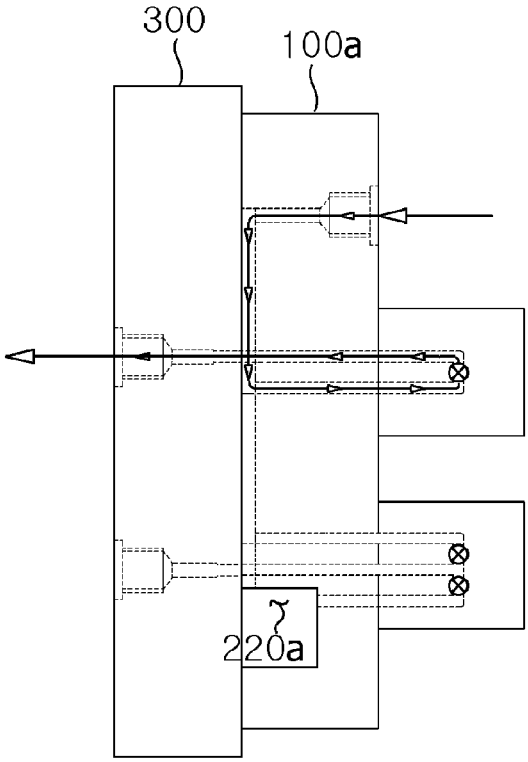
FIG. 16 is a view illustrating an ink/primer solution/coating solution/white color ink flow path (FIG. 16A), pneumatic/washing liquid flow path (FIG. 16B), and negative pressure flow path (FIG. 16C) (second negative pressure opening and closing valve is omitted) of the module of FIG. 14.
Figure 16B:
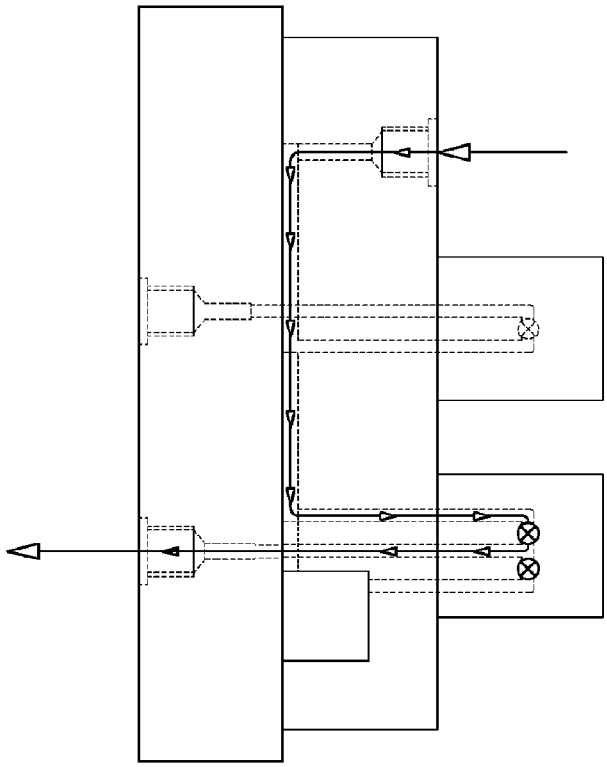
Figure 16C:
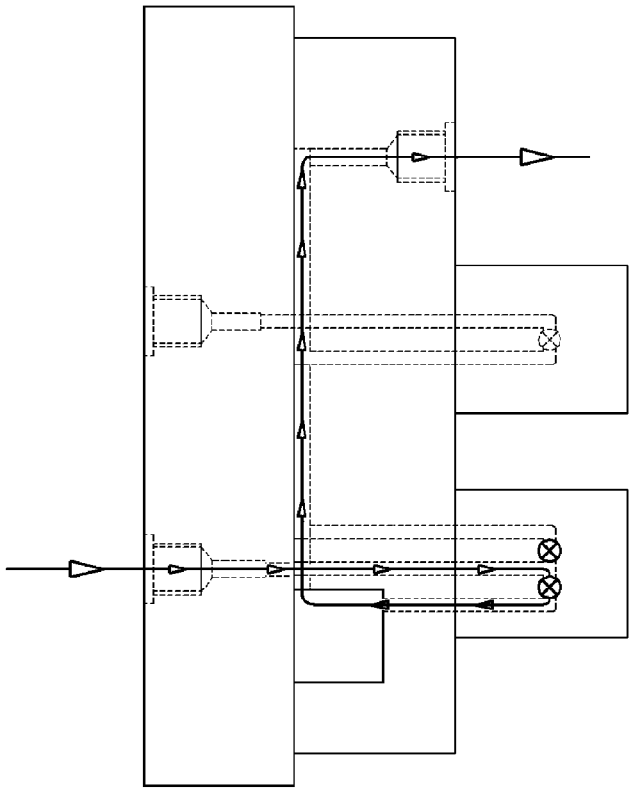

FIG. 14 is a disassembled perspective view illustrating an ink jet printer module according to further another embodiment of the present invention, and FIG. 15 is a cross sectional view illustrating a first unit, and FIG. 16 is a view illustrating an ink/primer solution/coating solution/white color ink flow path (FIG. 16A), pneumatic/washing liquid flow path (FIG. 16B), and negative pressure flow path (FIG. 16C) (second negative pressure opening and closing valve is omitted) of the module of FIG. 14.

The difference as compared to the module of FIG. 16 lies in that there are two units, not three units. The flow path groove and the negative pressure chamber are formed at the first unit.

Figure 17:
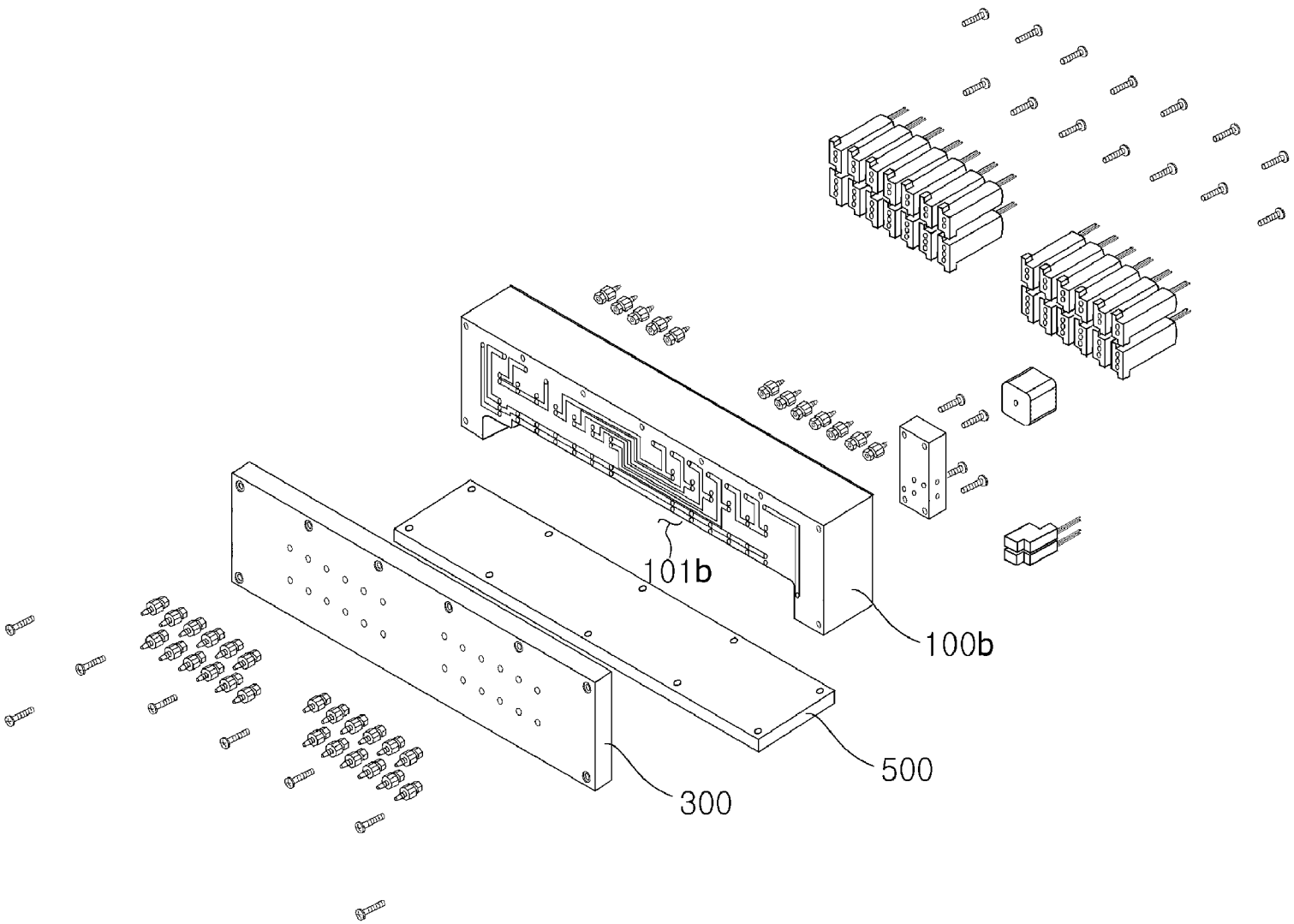
FIG. 17 is a disassembled perspective view illustrating an ink jet printer module according to further another embodiment of the present invention.
Figure 18:
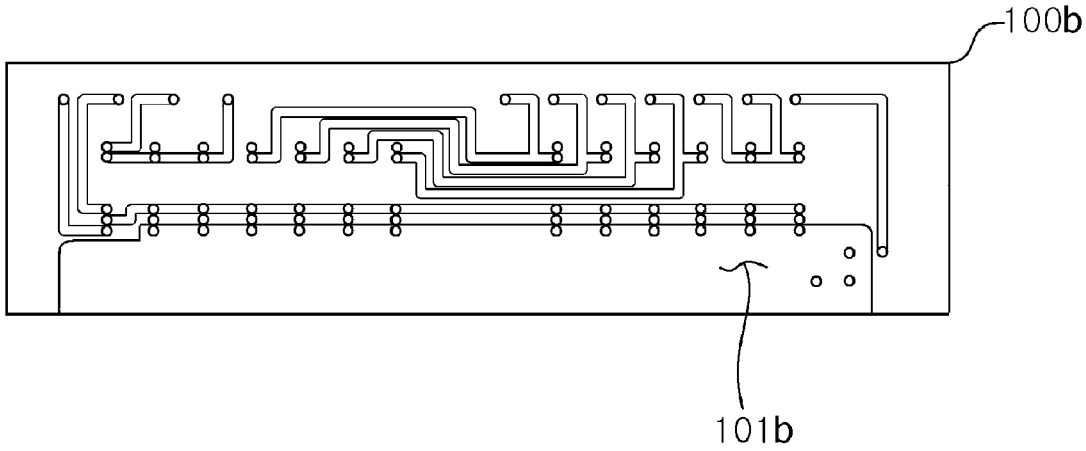
FIG. 18 is a cross sectional view illustrating a first unit of FIG. 17.
Figure 19A:
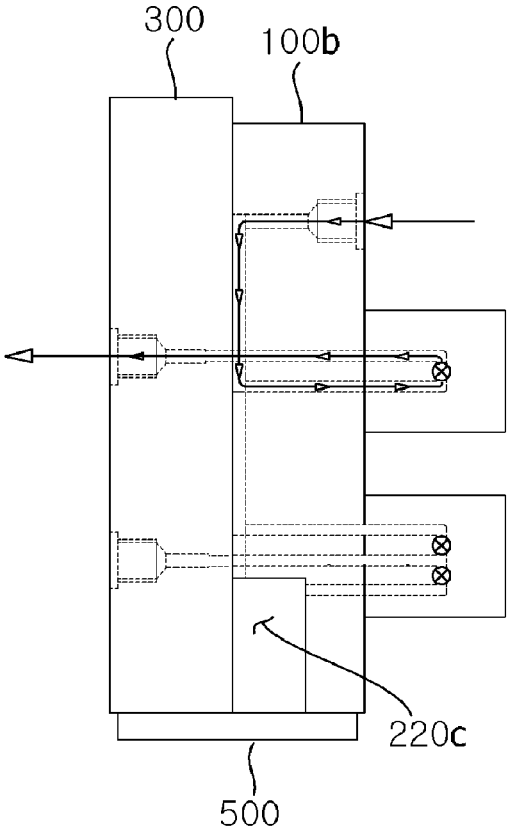
FIG. 19 is a view illustrating an ink/primer solution/coating solution/white color ink flow path (FIG. 19A), pneumatic/washing liquid flow path (FIG. 19B), and negative pressure flow path (FIG. 19C) (second negative pressure opening and closing valve is omitted) of the module of FIG. 17.
Figure 19B:
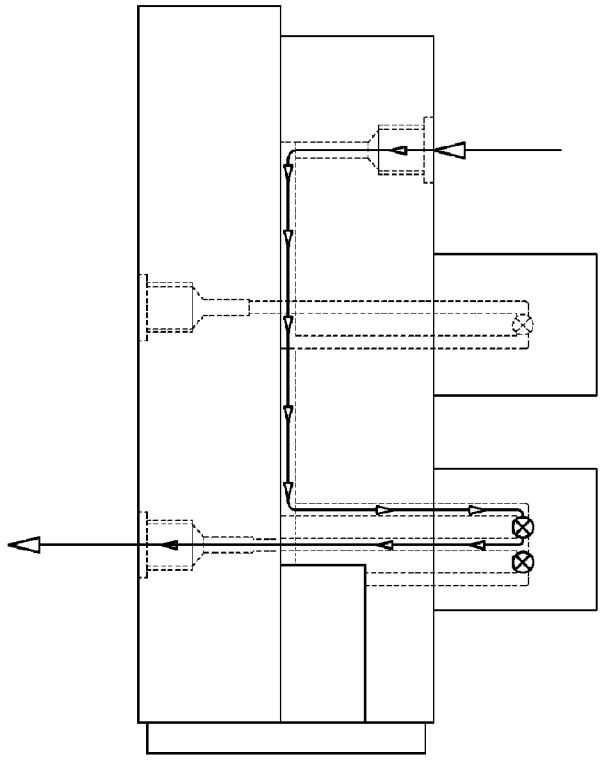
Figure 19C:
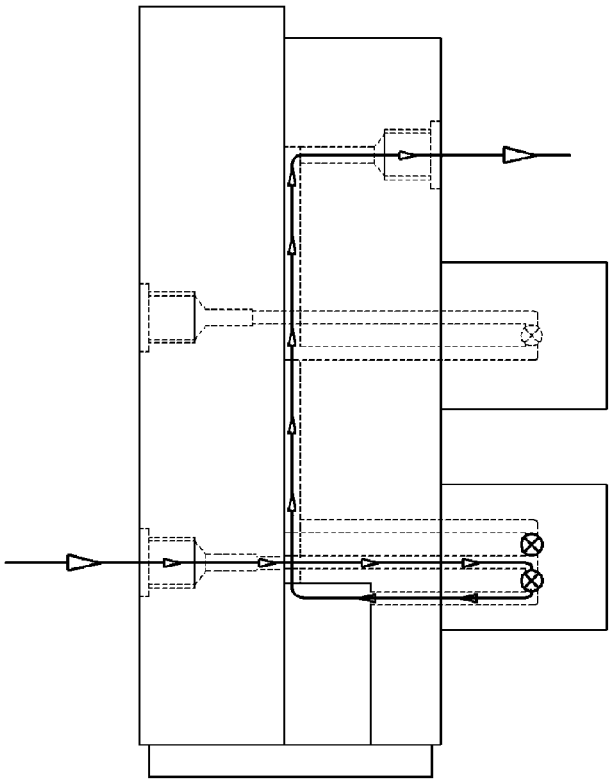
Figure 20:
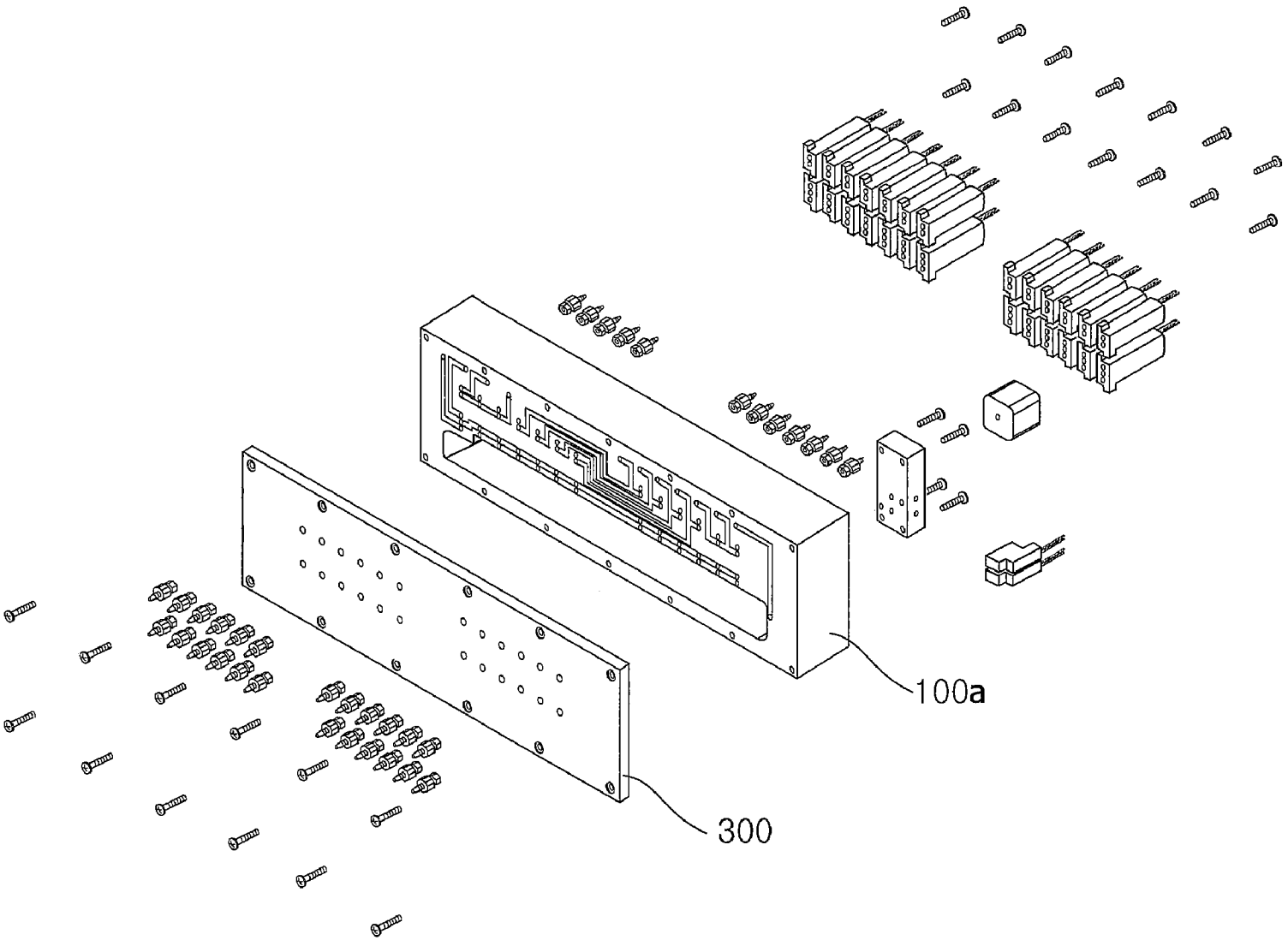
Figure 21:
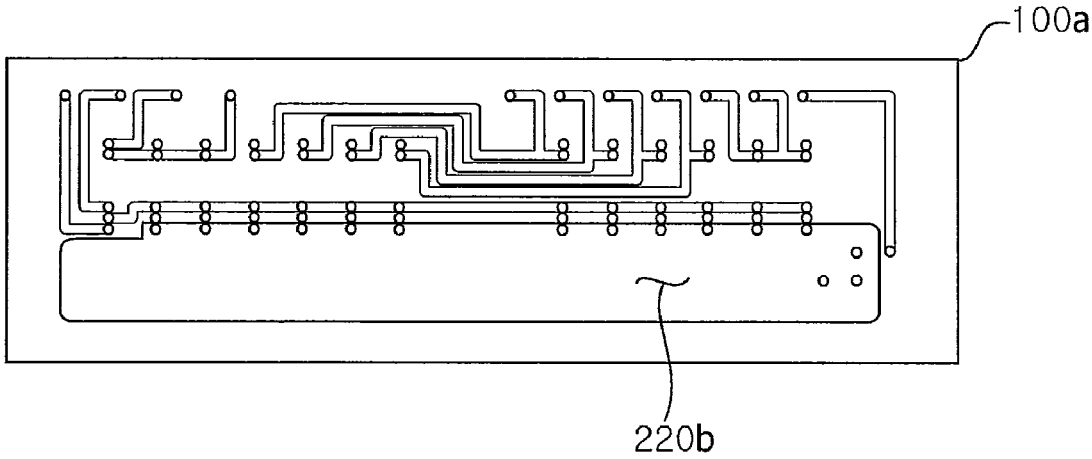
Figure 22:
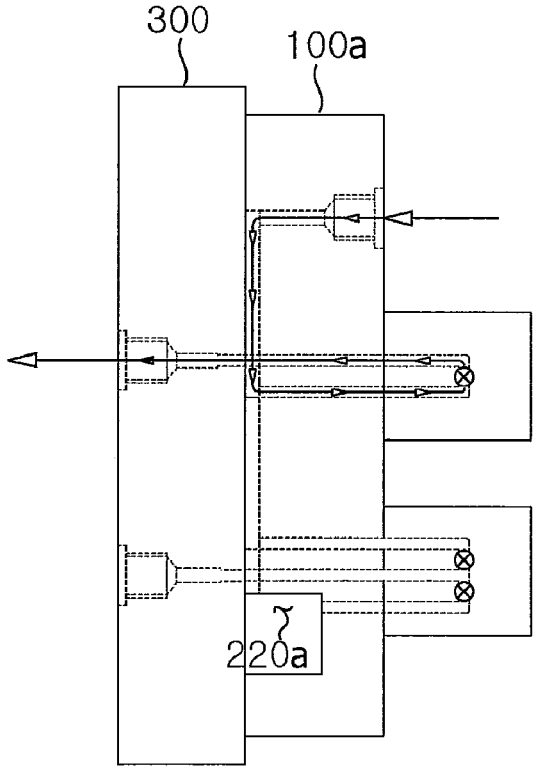
Figure 23:
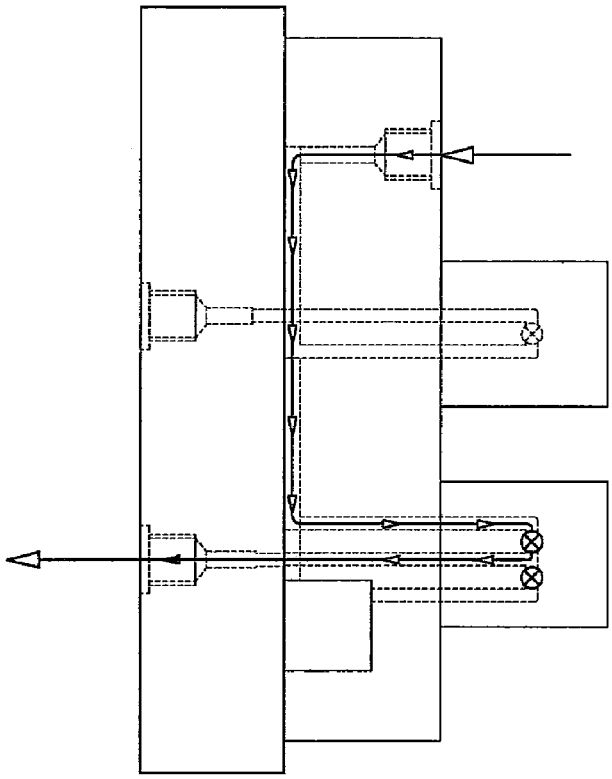
Figure 24:
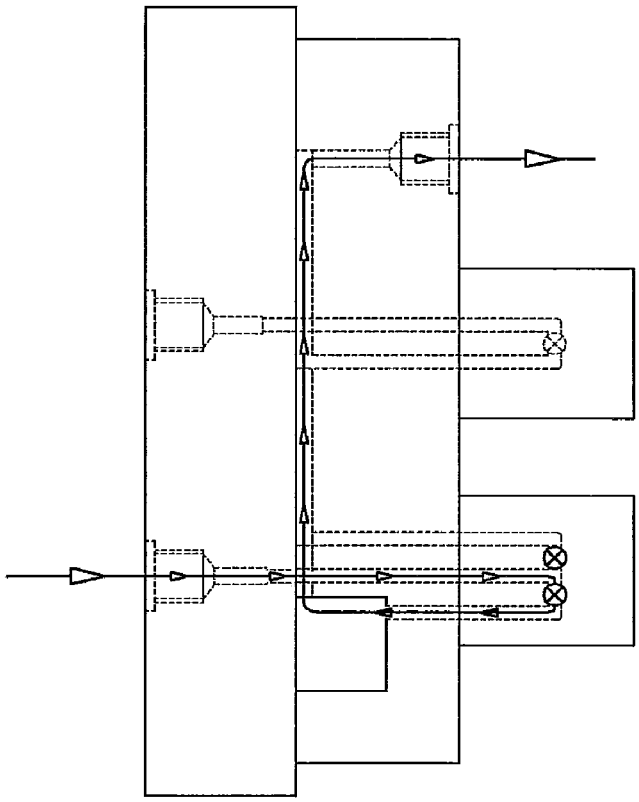
Figure 25:
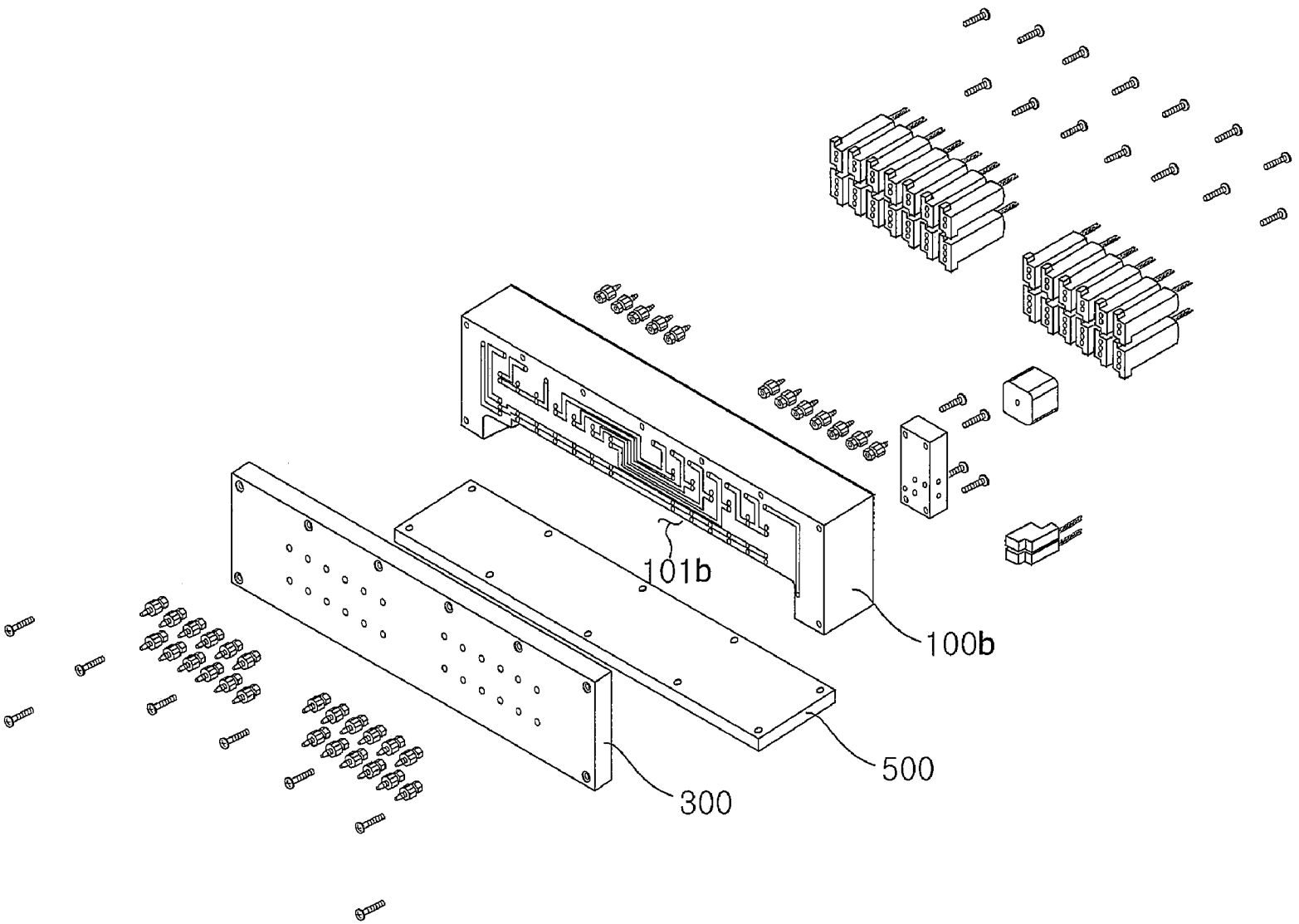
Figure 26:
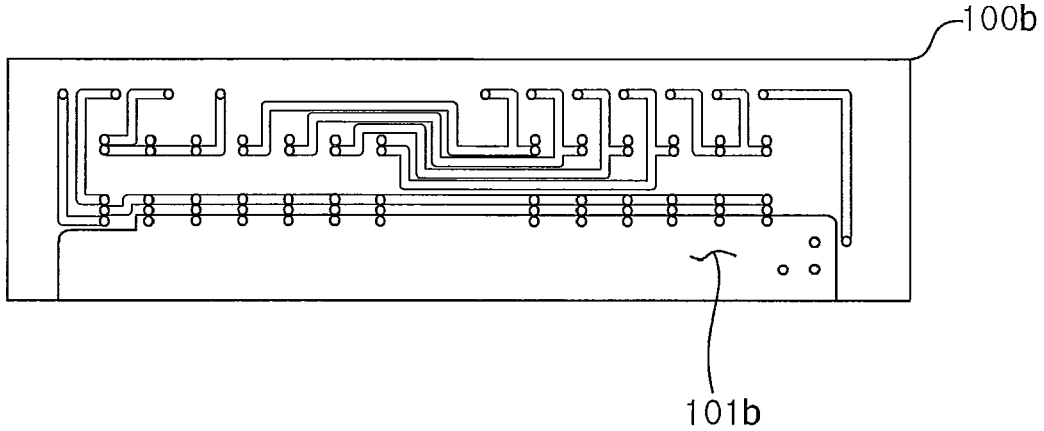
Figure 27:
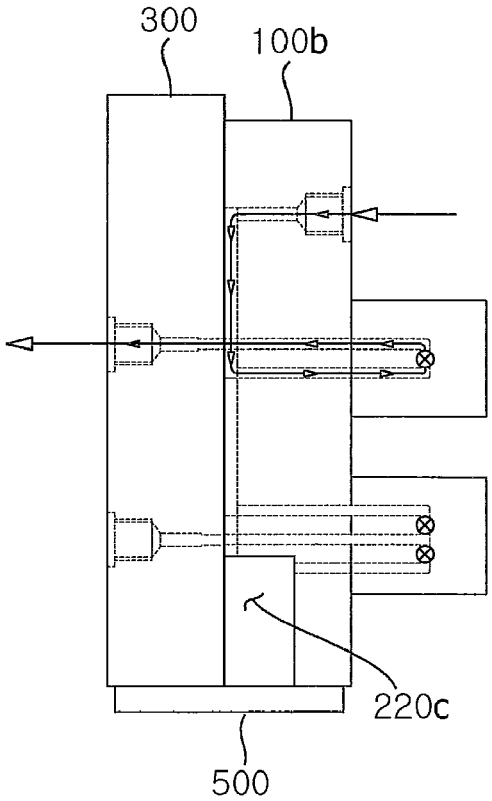
Figure 28:
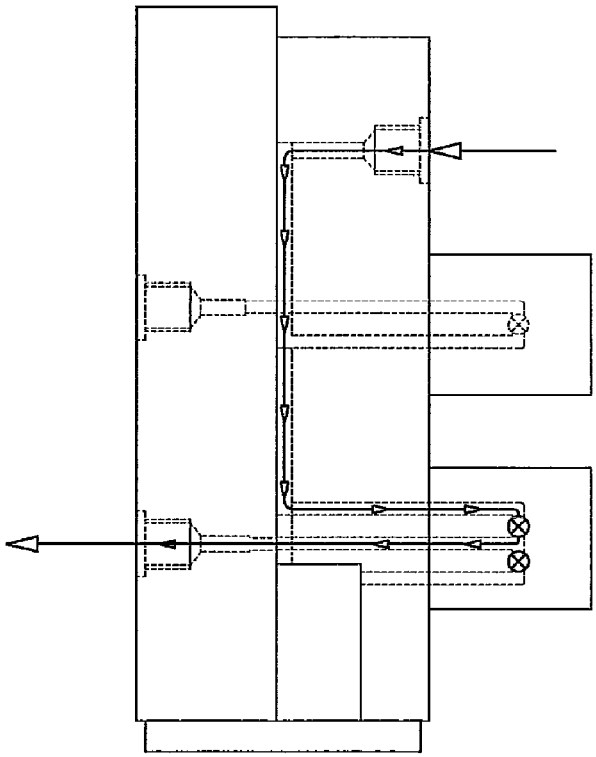
Figure 29:
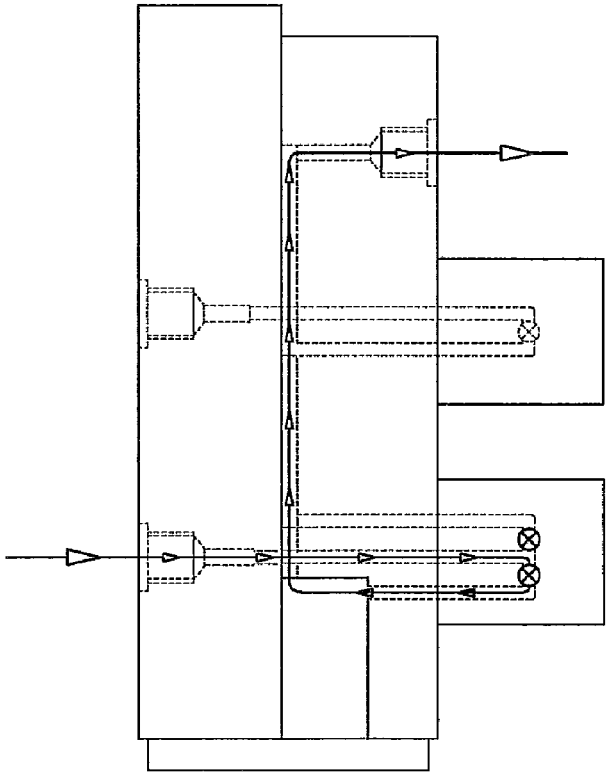

FIG. 17 is a disassembled perspective view illustrating an ink jet printer module according to further another embodiment of the present invention, and FIG. 18 is a cross sectional view illustrating a second unit, and FIG. 19 is a view illustrating an ink/primer solution/coating solution/white color ink flow path (FIG. 19A), pneumatic/washing liquid flow path (FIG. 19B), and negative pressure flow path (FIG. 19C) (second negative pressure opening and closing valve is omitted) of the module of FIG. 17.

The difference as compared to the module of FIG. 14 lies in that the lower side of the first unit is open, thus engaging the third unit which forms a floor board for thereby forming a negative pressure chamber.

Since the ink jet printer module according to the present invention integrates complicated flow paths and negative pressure chambers, it is preferred that the module is designed to have at least two units, and a metal or other materials having similar strengths are processed and engaged with one another.

INDUSTRIAL APPLICABILITY

The present invention relates to a part used for manufacturing an ink jet printer and a printer using the same, and in particular to a module used in an industrial ink jet printer and a printer using the same.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. An ink jet printer module which supplies ink, washing liquid and pneumatic from a main ink tank, a washing liquid tank and a pneumatic tank to a reservoir ink tank connected with an ink jet printer head, comprising:

a module body which forms an outer structure of the module;

an ink inlet port, a washing liquid inlet port and a pneumatic inlet port which are provided at the module body and are connected with the main ink tank, the washing liquid tank and the pneumatic pump, respectively;

an ink flow path, a washing liquid flow path, and a pneumatic flow path which are provided in the interior of the module body and communicate with the ink inlet port, the washing liquid inlet port and the pneumatic inlet port, respectively;

a common flow path which is provided in the interior of the module body and selectively communicates with either the washing liquid flow path or the washing liquid flow path, so that the pneumatic and washing liquid can be selectively inputted;

an ink opening and closing valve which is provided at the module body for controlling the opening and closing of the ink flow path;

a pneumatic and washing liquid selection valve which is provided in the module body and controls either the pneumatic or the washing liquid to be selectively inputted into the common low path;

an ink discharge port which is provided in the module body and discharges the ink of the ink flow path to the outside of the module body in accordance with a control of the ink opening and closing valve; and a common discharge port which is provided in the module body and discharges either the pneumatic or the washing liquid of the common flow path to the outside of the module body in accordance with a control of the pneumatic and washing liquid selection valve.

2. The module of claim 1, further comprising:

a common valve for controlling either the pneumatic or washing liquid of the common flow path to be discharged to the outside of the module body by means of the common discharge port.

3. The module of claim 1, further comprising a negative pressure chamber which is provided in the interior of the module body and is connected with the reservoir ink tank in order for the reservoir ink tank to receive negative pressure, said negative pressure chamber being connected with the common valve.

4. The module of claim 1, wherein said pneumatic and washing liquid selection valve is formed of a three-way valve.

5. The module of claim 3, wherein said common valve is formed of a three-way valve.

6. The module of claim 1, further comprising:

either a primer solution inlet port or a coating solution inlet port into which primer solution or coating solution are inputted;

either a primer solution opening and closing valve or a coating solution opening and closing valve for controlling the flow of either the primer solution or the coating solution; and a discharge port for discharging either the primer solution or the coating solution.

7. The module of claim 6, wherein said module comprises a primer solution inlet port and a coating solution inlet port which communicate with each other and selectively transfers the solution via one opening and closing valve.

8. The module of claim 1, wherein said module further comprises:

a white ink inlet port for inputting white ink;

an opening and closing valve for controlling the flow of the white ink; and a white ink discharge port.

9. The module of claim 8, further comprising:

a white ink feedback port which communicates with the white ink inlet port for feed backing the white ink to the white ink tank; and a feedback opening and closing valve for controlling the communication.

10. The module of claim 3, further comprising a sensor for measuring the pressure of the negative pressure chamber.

11. The module of claim 10, further comprising a negative pressure decrease opening and closing valve which operates in cooperation with the sensor and controls the input of an external air when over negative pressure occurs at the negative pressure chamber.

12. The module of claim 3, further comprising a discharge port for discharging the liquid inputted into the negative pressure chamber due to an error operation.

13. The module of claim 12, wherein a means for detecting the input of solution is provided in the interior of the negative pressure chamber.

14. The module of claim 3, wherein said module body comprises:

a first unit;

a second unit; and a third unit, and wherein an ink flow path, a pneumatic flow path, a washing liquid flow path and a common flow path are formed at an engaging surface between the first unit and the second unit, and wherein a negative pressure chamber is formed at an engaging surface between the second unit and the third unit.

15. The module of claim 3, wherein said module body comprises:

a first unit;

a second unit; and a third unit, and wherein an ink flow path, a pneumatic flow path, a washing liquid flow path, a common flow path and a negative pressure chamber are formed at an engaging surface between the first unit and the second unit.

16. The module of claim 3, wherein said module body comprises:

a first unit;

a second unit; and a third unit, and wherein an ink flow path, a pneumatic flow path, a washing liquid flow path and a common flow path are formed at an engaging surface between the first unit and the second unit, and wherein a negative pressure chamber is formed at an engaging surface between the first unit, the second unit and the third unit.

* * * * *